US008738173B2

(12) United States Patent
Tokura

(10) Patent No.: US 8,738,173 B2
(45) Date of Patent: May 27, 2014

(54) SEWING MACHINE AND NON-TRANSITORY COMPUTER-READABLE STORAGE MEDIUM STORING SEWING MACHINE CONTROL PROGRAM

(71) Applicant: Masashi Tokura, Konan (JP)

(72) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/671,004

(22) Filed: Nov. 7, 2012

(65) Prior Publication Data

US 2013/0112126 A1 May 9, 2013

(30) Foreign Application Priority Data

Nov. 9, 2011 (JP) ..... 2011-245417

(51) Int. Cl.
*D05C 5/00* (2006.01)

(52) U.S. Cl.
USPC ..... 700/138

(58) Field of Classification Search
USPC ..... 700/136–138; 112/478.18, 47.195, 112/475.19, 475.18
See application file for complete search history.

(56) References Cited

U.S. PATENT DOCUMENTS 6,032,594 A * 3/2000 Komuro ..... 112/102.5
6,131,526 A * 10/2000 Iida et al. ..... 112/102.5
6,167,822 B1 * 1/2001 Miyasako et al. ..... 112/102.5
6,173,665 B1 * 1/2001 Sekine ..... 112/102.5
6,263,815 B1 * 7/2001 Furudate ..... 112/470.13
6,820,565 B1 * 11/2004 Kawaguchi et al. ..... 112/102.5
6,983,193 B2 * 1/2006 Mizuno et al. ..... 700/138
7,155,302 B2 * 12/2006 Muto et al. ..... 700/138
7,392,755 B2 * 7/2008 Kato et al. ..... 112/102.5
8,091,493 B2 * 1/2012 Tokura ..... 112/470.01
8,267,024 B2 * 9/2012 Hayakawa et al. ..... 112/470.04
8,340,804 B2 * 12/2012 Yamada et al. ..... 700/138
2004/0221780 A1 11/2004 Kawaguchi et al.

(Continued)

FOREIGN PATENT DOCUMENTS

JP A-2004-254987 9/2004
JP A-2010-246885 11/2010

(Continued)

OTHER PUBLICATIONS

U.S. Appl. No. 13/671,012, filed in the name of Takura, Nov. 7, 2012.

(Continued)

*Primary Examiner* — Danny Worrell
(74) *Attorney, Agent, or Firm* — Oliff PLC

(57) ABSTRACT

A sewing machine includes an imaging device that captures an image of a sewing target object, a notification device, a processor and a memory. The processor acquires settings related to a layout of a second pattern with respect to a first pattern, and identifies a marker layout position. The processor causes the notification device to notify the identified marker layout position. The processor acquires first image data indicating an image in a first holding position. The image includes a marker arranged on the sewing target object. The processor acquires second image data indicating an image in a second holding position after the first image data has been acquired. The image includes the marker. The processor determines a layout of the second pattern with respect to the sewing target object in the second holding position, based on the acquired settings, the first image data and the second image data.

11 Claims, 20 Drawing Sheets

(56) References Cited

U.S. PATENT DOCUMENTS

| | | | | |
|---|---|---|---|---|
| 2005/0234584 | A1* | 10/2005 | Mizuno et al. | 700/138 |
| 2007/0206371 | A1* | 9/2007 | Yamasaki | 362/90 |
| 2009/0188413 | A1* | 7/2009 | Hirata et al. | 112/103 |
| 2009/0217850 | A1* | 9/2009 | Tokura | 112/102.5 |
| 2009/0266282 | A1* | 10/2009 | Suzuki et al. | 112/470.03 |
| 2010/0236463 | A1* | 9/2010 | Fujihara et al. | 112/470.05 |
| 2010/0242817 | A1 | 9/2010 | Tokura | |
| 2012/0048162 | A1* | 3/2012 | Tokura | 112/102.5 |
| 2012/0191237 | A1* | 7/2012 | Tokura | 700/138 |
| 2012/0272884 | A1 | 11/2012 | Tokura | |
| 2013/0112126 | A1* | 5/2013 | Tokura | 112/102.5 |
| 2013/0112127 | A1* | 5/2013 | Tokura | 112/102.5 |
| 2013/0133561 | A1* | 5/2013 | Ikeba et al. | 112/102.5 |

FOREIGN PATENT DOCUMENTS

| | | |
|---|---|---|
| JP | A-2011-9709 | 1/2011 |
| JP | A-2011-211315 | 10/2011 |
| JP | A-2012-147985 | 8/2012 |
| JP | A-2012-192156 | 10/2012 |
| JP | A-2012-228472 | 11/2012 |

OTHER PUBLICATIONS

Sep. 24, 2013 Notice of Allowance issued in U.S. Appl. No. 13/671,012.

* cited by examiner

SEWING MACHINE AND NON-TRANSITORY COMPUTER-READABLE STORAGE MEDIUM STORING SEWING MACHINE CONTROL PROGRAM

CROSS-REFERENCE TO RELATED APPLICATION

This application claims priority from JP2011-245417, filed on Nov. 9, 2011, the content of which is hereby incorporated by reference.

BACKGROUND

The present disclosure relates to a sewing machine that performs positioning between a plurality of patterns using images of markers arranged on a sewing target object held by an embroidery frame, and to a non-transitory computer-readable storage medium storing a sewing machine control program.

Generally, a sewing machine capable of embroidery sewing performs embroidery sewing in a sewable area, using an embroidery frame that holds a sewing target object. The sewable area is set inside the embroidery frame in accordance with a type of the embroidery frame. In this type of sewing machine, an embroidery pattern that is larger than the sewable area is divided into a plurality of patterns that are smaller than the sewable area, and sewing data corresponding to the plurality of patterns is stored. This sewing machine sequentially sews the plurality of divided patterns in accordance with the sewing data, thereby sewing the embroidery pattern that is larger than the sewable area. Every time one of the plurality of divided patterns is sewn, a user reattaches a work cloth, which is the sewing target object, with respect to the embroidery frame. The sewing machine is provided with an image capturing device, and captures images of markers arranged on a surface of the work cloth, before and after the reattachment of the work cloth. Then, based on these images of the markers, the sewing machine performs positioning between the plurality of patterns.

SUMMARY

In order for the above-described sewing machine to accurately perform positioning between the plurality of patterns, it is necessary to arrange the markers on the work cloth within a range that satisfies a predetermined condition. However, when the markers are not arranged in appropriate positions (for example, when the user himself/herself does not recognize this condition, or when the user cannot identify the appropriate positions), the sewing machine cannot perform positioning between the plurality of patterns based on the images of the markers.

The present disclosure allows a user to arrange markers in appropriate positions when using a sewing machine that is capable of performing positioning between a plurality of patterns based on images of the markers.

A sewing machine according to a first aspect of the present disclosure includes an imaging device that captures an image of a sewing target object held by an embroidery frame, a notification device that notifies a predetermined position, a processor, and a memory that stores instructions. The processor acquires settings related to a layout of a second pattern with respect to a first pattern. The first pattern is a pattern that is sewn in a first holding position of the sewing target object by the embroidery frame. The second pattern is a pattern that is sewn subsequently to the first pattern in a second holding position is a second holding position of the sewing target object by the embroidery frame. The second holding position is different from the first holding position. Based on the acquired settings, the processor identifies, as a marker layout position, a position which is located within a sewable area of the sewing target object in the first holding position and which is also located within an estimated range in which the second pattern is to be sewn. The processor causes the notification device to notify the identified marker layout position. The processor acquires first image data indicating an image including a marker arranged on the sewing target object, the image being captured by the imaging device in the first holding position after the marker layout position has been notified by the notification device. Further, the processor acquires second image data indicating an image including the marker, the image being captured by the imaging device in the second holding position after the first image data has been acquired. The processor determines a layout of the second pattern with respect to the sewing target object in the second holding position, based on the acquired settings, the first image data and the second image data.

A non-transitory computer-readable storage medium storing a sewing machine control program according to a second aspect of the present disclosure includes instructions that instruct a sewing machine to execute steps of acquiring settings related to a layout of a second pattern with respect to a first pattern. The first pattern is a pattern that is sewn in a first holding position of a sewing target object held by an embroidery frame. The second pattern is a pattern that is sewn subsequently to the first pattern in a second holding position of the sewing target object held by the embroidery frame. The second holding position is different from the first holding position. The instructions further instruct the sewing machine to execute steps including: identifying, based on the acquired settings, a position which is located within a sewable area of the sewing target object in the first holding position and which is also located within an estimated range in which the second pattern is to be sewn, as a marker layout position; causing a notification device to notify the identified marker layout position; acquiring first image data indicating an image including a marker arranged on the sewing target object, the image being captured by an imaging device in the first holding position after the marker layout position has been notified by the notification device; acquiring second image data indicating an image including the marker, the image being captured by the imaging device in the second holding position after the first image data has been acquired; and determining a layout of the second pattern with respect to the sewing target object in the second holding position, based on the acquired settings, the first image data and the second image data.

A sewing machine according to a third aspect of the present disclosure includes a processor and a memory that stores instructions. The processor acquires settings related to a layout of a second pattern with respect to a first pattern. The first pattern is a pattern that is sewn in a first holding position of a sewing target object held by an embroidery frame. The second pattern is a pattern that is sewn subsequently to the first pattern in a second holding position is a second holding position of the sewing target object held by the embroidery frame. The second holding position is different from the first holding position. Based on the acquired settings, the processor identifies, as a marker layout position, a position which is located within a sewable area of the sewing target object in the first holding position and which is also located within an estimated range in which the second pattern is to be sewn. The processor sends a notification instruction to a notification device. The notification instruction causes the notification device to notify the identified marker layout position. The processor acquires, after the notification instruction has been sent to the notification device, first image data indicating an image including a marker arranged on the sewing target object by sending a first imaging instruction to an imaging device in the first holding position. Further, the processor acquires, after the first image data has been acquired, second image data indicating an image including the marker by sending a second imaging instruction to the imaging device in the second holding position. The processor determines a layout of the second pattern with respect to the sewing target object in the second holding position, based on the acquired settings, the first image data and the second image data.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter, an embodiment of the present disclosure will be explained with reference to the drawings. A configuration of a multi-needle sewing machine (hereinafter simply referred to as a sewing machine) 1 according to the embodiment will be explained with reference to FIG. 1 to FIG. 3. In the explanation below, the upper side, the lower side, the lower left side, the upper right side, the upper left side and the lower right side of FIG. 1 respectively correspond to the upper side, the lower side, the front side, the back side, the left side and the right side of the sewing machine 1.

Figure 1:
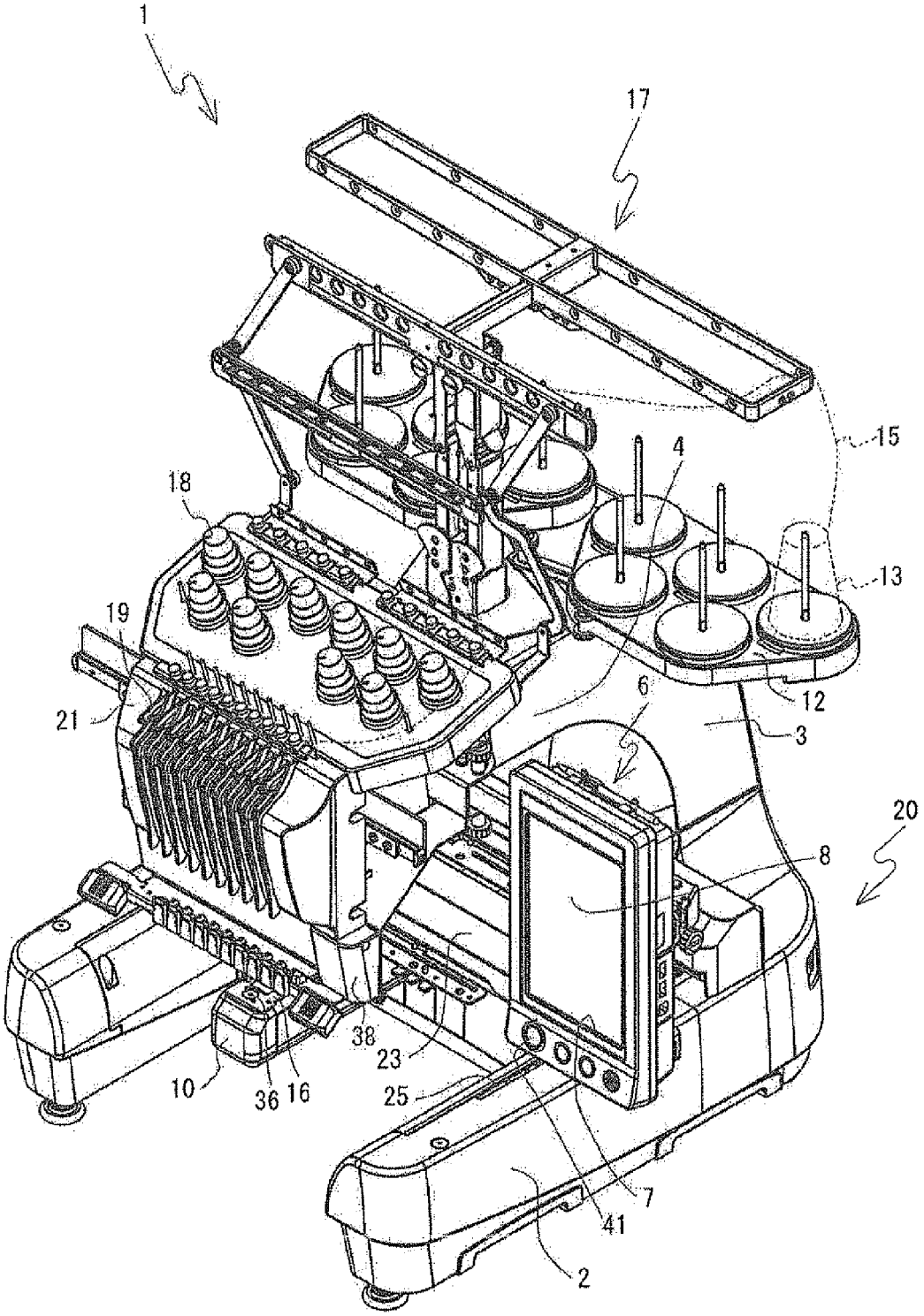
FIG. 1 is a perspective view of a multi-needle sewing machine 1.

As shown in FIG. 1, a main body 20 of the sewing machine 1 is provided with a support portion 2, a pillar 3 and an arm portion 4. The support portion 2 is formed in an inverted U-shape in a plan view, and supports the whole of the sewing machine 1. A pair of left and right guide grooves 25, which extend in a front-rear direction, are provided in an upper surface of the support portion 2. The pillar 3 is provided so as to extend upward from a rear end portion of the support portion 2. The arm portion 4 extends to the front from an upper end portion of the pillar 3. A needle bar case 21 is attached to the tip end of the arm portion 4 such that the needle bar case 21 can move in a left-right direction. Ten needle bars 31 (refer to FIG. 3), which extend in an up-down direction, are disposed inside the needle bar case 21 at an equal interval in the left-right direction. Of the ten needle bars 31, the needle bar 31 that is in a sewing position is caused to slide in the up-down direction by a needle bar drive mechanism 32 (refer to FIG. 3) that is provided inside the needle bar case 21. A needle 35 (refer to FIG. 3) is detachably attached to the lower end of each of the needle bars 31.

A cover 38 is provided on a lower portion of a right side surface of the needle bar case 21. An image sensor holding mechanism (not shown in the drawings) is attached to the inner side of the cover 38. The image sensor holding mechanism is provided with an image sensor 50 (refer to FIG. 3). The image sensor 50 is a known complementary metal oxide semiconductor (CMOS) image sensor. A lens (not shown in the drawings) of the image sensor 50 is directed below the sewing machine 1.

An operation portion 6 is provided on the right side of a central portion in the front-rear direction of the arm portion 4. The operation portion 6 is provided with a liquid crystal display (LCD) 7, a touch panel 8 and a start/stop switch 41. The LCD 7 may display various types of information, such as operation images used by a user to input a command, for example. The touch panel 8 may be used to receive a command from the user. The user can select or set various types of conditions, such as a sewing pattern and a sewing condition, by performing a pressing operation (this operation is hereinafter referred to as a "panel operation"), using a finger or a touch pen, on sections of the touch panel 8 that correspond to positions of input keys etc. displayed on the LCD 7. The start/stop switch 41 may be used to issue a command to start or stop sewing.

A cylinder-shaped cylinder bed 10, which extends to the front from a lower end portion of the pillar 3, is provided below the arm portion 4. A shuttle (not shown in the drawings) is provided inside a leading end portion of the cylinder bed 10. The shuttle houses a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) may rotatably drive the shuttle. A needle plate 16, having a rectangular shape in a plan view, is provided on an upper surface of the cylinder bed 10. The needle plate 16 is provided with a needle hole 36 through which the needle 35 (refer to FIG. 3) passes.

A pair of left and right thread spool bases 12 are provided on a back surface side of an upper surface of the arm portion 4. The number of thread spools 13 that can be mounted on the pair of the thread spool bases 12 is ten, which is the same as the number of the needle bars 31. A needle thread 15 is supplied from one of the thread spools 13 mounted on the thread spool bases 12. The needle thread 15 is supplied, via a thread guide 17, a tensioner 18, a thread take-up lever 19 and the like, to a needle hole (not shown in the drawings) of each of the needles 35 attached to the lower end of each of the needle bars 31.

A Y carriage 23 of an embroidery frame movement mechanism 11 (refer to FIG. 2) is provided below the arm portion 4. The embroidery frame movement mechanism 11 may detachably support an embroidery frame 84 (refer to FIG. 2) of various types. The embroidery frame 84 may hold a sewing target object (such as a work cloth) 39. The embroidery frame movement mechanism 11 uses an X-axis motor 132 (refer to FIG. 3) and a Y-axis motor 134 (refer to FIG. 3) as driving sources, and thereby causes the embroidery frame 84 to move back and forth and left and right.

The embroidery frame 84 and the embroidery frame movement mechanism 11 will be explained with reference to FIG. 2. The embroidery frame 84 is provided with an outer frame 81, an inner frame 82 and a pair of left and right coupling portions 89. The outer frame 81 and the inner frame 82 of the embroidery frame 84 clamp the sewing target object 39. The user can change the holding position of the sewing target object 39 with respect to the embroidery frame 84, by changing sections of the sewing target object 39 clamped by the outer frame 81 and the inner frame 82. The coupling portions 89 are plate members having a rectangular shape in a plan view, and their central portions are cut out in a rectangular shape. One of the coupling portions 89 is fixed to a right portion of the inner frame 82 by screws 95 while the other of the coupling portions 89 is fixed to a left portion of the inner frame 82 by screws 94. In addition to the embroidery frame 84 exemplified in FIG. 2, a plurality of types of the embroidery frame 84 that are different in size and shape can be mounted on the sewing machine 1. The embroidery frame 84 exemplified in FIG. 2 has a width in the left-right direction (i.e., a distance between the left and right coupling portions 89) that is largest among the embroidery frames 84 that can be used for the sewing machine 1.

A sewable area 86 may be automatically set on the inner side of the inner frame 82 by a CPU 61 (refer to FIG. 3) of the sewing machine 1 in accordance with a type of the embroidery frame 84, based on an output signal of a known detector (not shown in the drawings), for example. Alternatively, the embroidery frame 84 to be used may be selected by the user through a panel operation, and the sewable area 86 corresponding to the selected embroidery frame 84 may be set.

The embroidery frame movement mechanism 11 is provided with a holder 24, an X carriage 22, an X-axis drive mechanism (not shown in the drawings), the Y carriage 23 and a Y-axis movement mechanism (not shown in the drawings). The holder 24 may detachably support the embroidery frame 84. The holder 24 is provided with a mounting portion 91, a right arm portion 92 and a left arm portion 93. The mounting portion 91 is a plate member having a rectangular shape in a plan view. The mounting portion 91 is longer in the left-right direction. The right arm portion 92 is a plate member extending in the front-rear direction. The right arm portion 92 is fixed to the right end of the mounting portion 91. The left arm portion 93 is a plate member extending in the front-rear direction. The left arm portion 93 is fixed to a left portion of the mounting portion 91 such that the position in the left-right direction with respect to the mounting portion 91 can be adjusted. The right arm portion 92 is engaged with the one of the coupling portions 89 of the embroidery frame 84 while the left arm portion 93 is engaged with the other of the coupling portions 89.

The X carriage 22 is a plate member and is longer in the left-right direction. A part of the X carriage 22 protrudes toward the front from the front face of the Y carriage 23. The mounting portion 91 of the holder 24 is attached to the X carriage 22. The X-axis drive mechanism (not shown in the drawings) is provided with a linear movement mechanism (not shown in the drawings). The linear movement mechanism is provided with a timing pulley (not shown in the drawings) and a timing belt (not shown in the drawings). The linear movement mechanism causes the X carriage 22 to move in the left-right direction (in the X-axis direction) using the X-axis motor 132 as a driving source.

The Y carriage 23 has a box shape and is longer in the left-right direction. The Y carriage 23 supports the X carriage 22 such that the X carriage 22 can move in the left-right direction. The Y-axis movement mechanism (not shown in the drawings) is provided with a pair of left and right movable objects (not shown in the drawings) and a linear movement mechanism (not shown in the drawings). The movable objects are connected to lower portions of the left and right ends of the Y carriage 23, and vertically pass through the guide grooves 25 (refer to FIG. 1). The linear movement mechanism is provided with a timing pulley (not shown in the drawings) and a timing belt (not shown in the drawings). The linear movement mechanism causes the movable objects to move in the front-rear direction (in the Y-axis direction) along the guide grooves 25, using the Y-axis motor 134 as a driving source. The Y carriage 23 that is connected to the movable objects, and the X carriage 22 that is supported by the Y carriage 23 move in the front-rear direction (in the Y-axis direction) in accordance with movement of the movable objects. When the embroidery frame 84 that holds the sewing target object 39 is attached to the X carriage 22, the sewing target object 39 is disposed between the needle bars 31 and the needle plate 16 (refer to FIG. 1).

Figure 3:
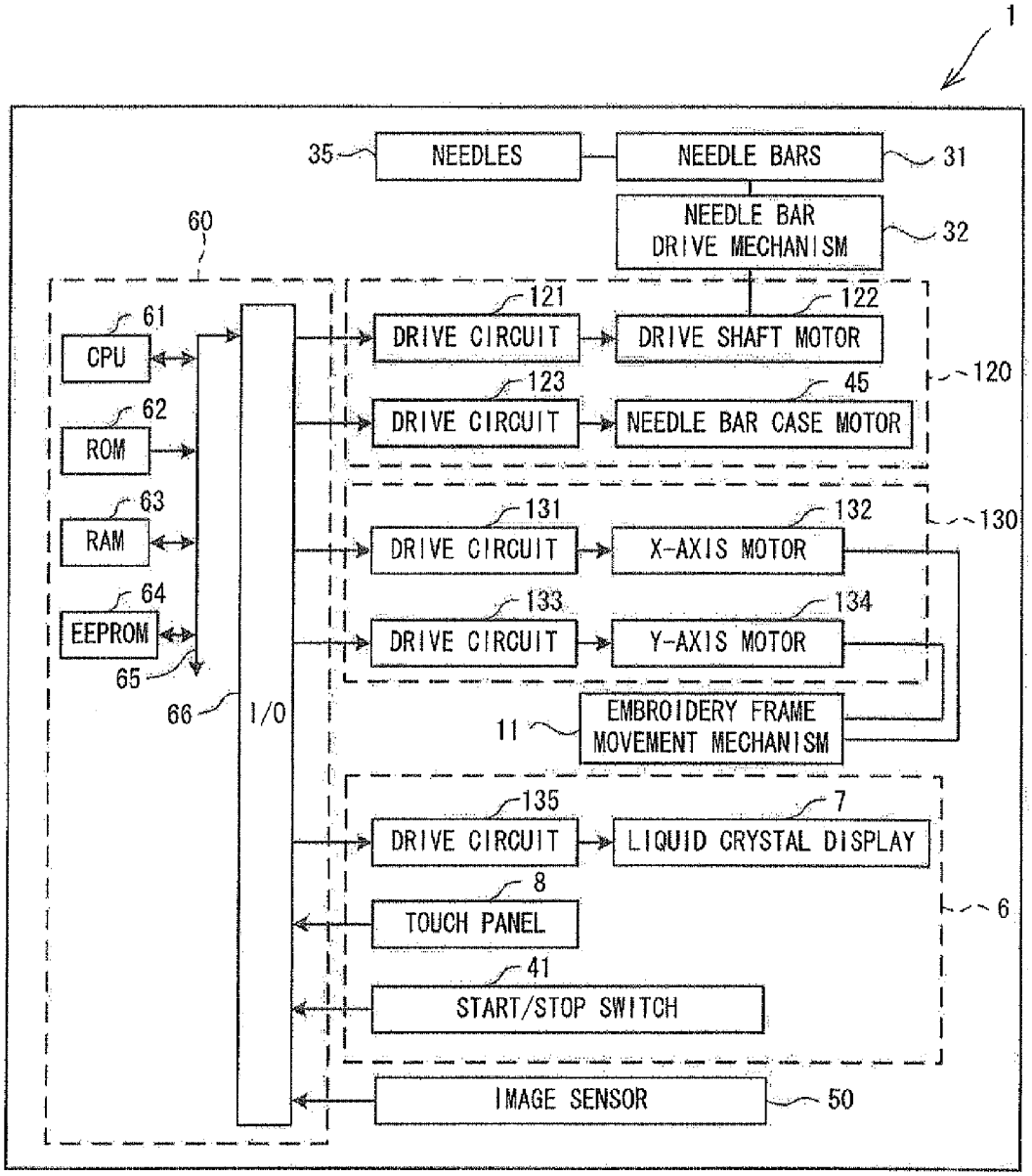
FIG. 3 is a block diagram showing an electrical configuration of the multi-needle sewing machine 1.

An electrical configuration of the sewing machine 1 will be explained with reference to FIG. 3. The sewing machine 1 is provided with a needle drive portion 120, a sewing target drive portion 130, the operation portion 6, a control portion 60 and the image sensor 50.

The needle drive portion 120 is provided with a drive shaft motor 122, drive circuits 121 and 123, and a needle bar case motor 45. The drive shaft motor 122 causes the needle bar 31 to reciprocate in the up-down direction. The drive circuit 121 may drive the drive shaft motor 122 in accordance with a control signal from the control portion 60. The needle bar case motor 45 causes the needle bar case 21 to move in the left-right direction. The drive circuit 123 may drive the needle bar case motor 45 in accordance with a control signal from the control portion 60.

The sewing target drive portion 130 is provided with the X-axis motor 132, drive circuits 131 and 133, and the Y-axis motor 134. The X-axis motor 132 may drive the embroidery frame movement mechanism 11 and thereby causes the embroidery frame 84 (refer to FIG. 2) to move in the left-right direction. The drive circuit 131 may drive the X-axis motor 132 in accordance with a control signal from the control portion 60. The Y-axis motor 134 may drive the embroidery frame movement mechanism 11 and thereby causes the embroidery frame 84 to move in the front-rear direction. The drive circuit 133 may drive the Y-axis motor 134 in accordance with a control signal from the control portion 60.

The operation portion 6 is provided with the touch panel 8, a drive circuit 135, the LCD 7 and the start/stop switch 41. The drive circuit 135 may drive the LCD 7 in accordance with a control signal from the control portion 60.

The control portion 60 is provided with the CPU 61, a ROM 62, a RAM 63, an EEPROM 64 and an input/output (I/O) interface 66, and they are mutually connected by a signal line 65. The needle drive portion 120, the sewing target drive portion 130, the operation portion 6 and the image sensor 50 are respectively connected to the I/O interface 66.

The CPU 61 performs main control of the sewing machine 1. The CPU 61 performs various operations and processing that relate to sewing, in accordance with various programs stored in a program storage area (not shown in the drawings) of the ROM 62. Although not shown in the drawings, the ROM 62 is provided with a plurality of storage areas including the program storage area and a pattern storage area. Various programs to operate the sewing machine 1, including a main program, are stored in the program storage area. The main program is a program to perform main processing, which will be described later. Sewing data, which is data to sew a pattern (hereinafter also referred to as an "embroidery pattern"), is stored in the pattern storage area. The RAM 63 includes, if necessary, a storage area to store operation results etc. processed by the CPU 61. Various parameters for the sewing machine 1 to perform various types of processing are stored in the EEPROM 64. Further, each of the needle bars 31, and the color of the needle thread 15 that is supplied to the needle hole (not shown in the drawings) of each of the needles 35 attached to the lower end of each of the needle bars 31, are associated and stored in the EEPROM 64. The sewing data may be stored in the EEPROM 64.

Operations to form stitches on the sewing target object 39 held by the embroidery frame 84 will be explained with reference to FIG. 1 to FIG. 3. The embroidery frame 84 that may hold the sewing target object 39 is supported by the embroidery frame movement mechanism 11. One of the ten needle bars 31 may be selected by movement of the needle bar case 21 from side to side. The embroidery frame 84 may be moved to a predetermined position by the embroidery frame movement mechanism 11. When a drive shaft (not shown in the drawings) may be driven and rotated by the drive shaft motor 122, the needle bar drive mechanism 32 and a thread take-up lever drive mechanism (not shown in the drawings) may be driven, and the selected needle bar 31 and the thread take-up lever 19 corresponding to the selected needle bar 31 may be vertically driven. Further, the shuttle drive mechanism may be driven by rotation of the drive shaft motor 122, and the shuttle may be driven and rotated. In this way, the needle 35, the thread take-up lever 19 and the shuttle may be driven in a synchronized manner, and stitches are formed on the sewing target object 39.

Sewing data of the present embodiment will be explained with reference to FIG. 2. The sewing data of the present embodiment may include coordinate data of an embroidery coordinate system 100 shown in FIG. 2. The embroidery coordinate system 100 is a coordinate system of the X-axis motor 132 that causes the X carriage 22 to move and the Y-axis motor 134. The coordinate data of the embroidery coordinate system 100 represents a position and an angle of the embroidery pattern with respect to a reference (for example, the X carriage 22). The embroidery frame 84 that holds the sewing target object 39 is attached to the X carriage 22. Therefore, the coordinate data of the embroidery coordinate system 100 represents the position and the angle of the embroidery pattern with respect to the sewing target object 39 held by the embroidery frame 84. In the present embodiment, the embroidery coordinate system 100 and a world coordinate system are associated with each other in advance. The world coordinate system is a coordinate system that shows the whole space. The world coordinate system is a coordinate system that is not affected by the center of gravity etc. of an image capture target object.

Figure 2:
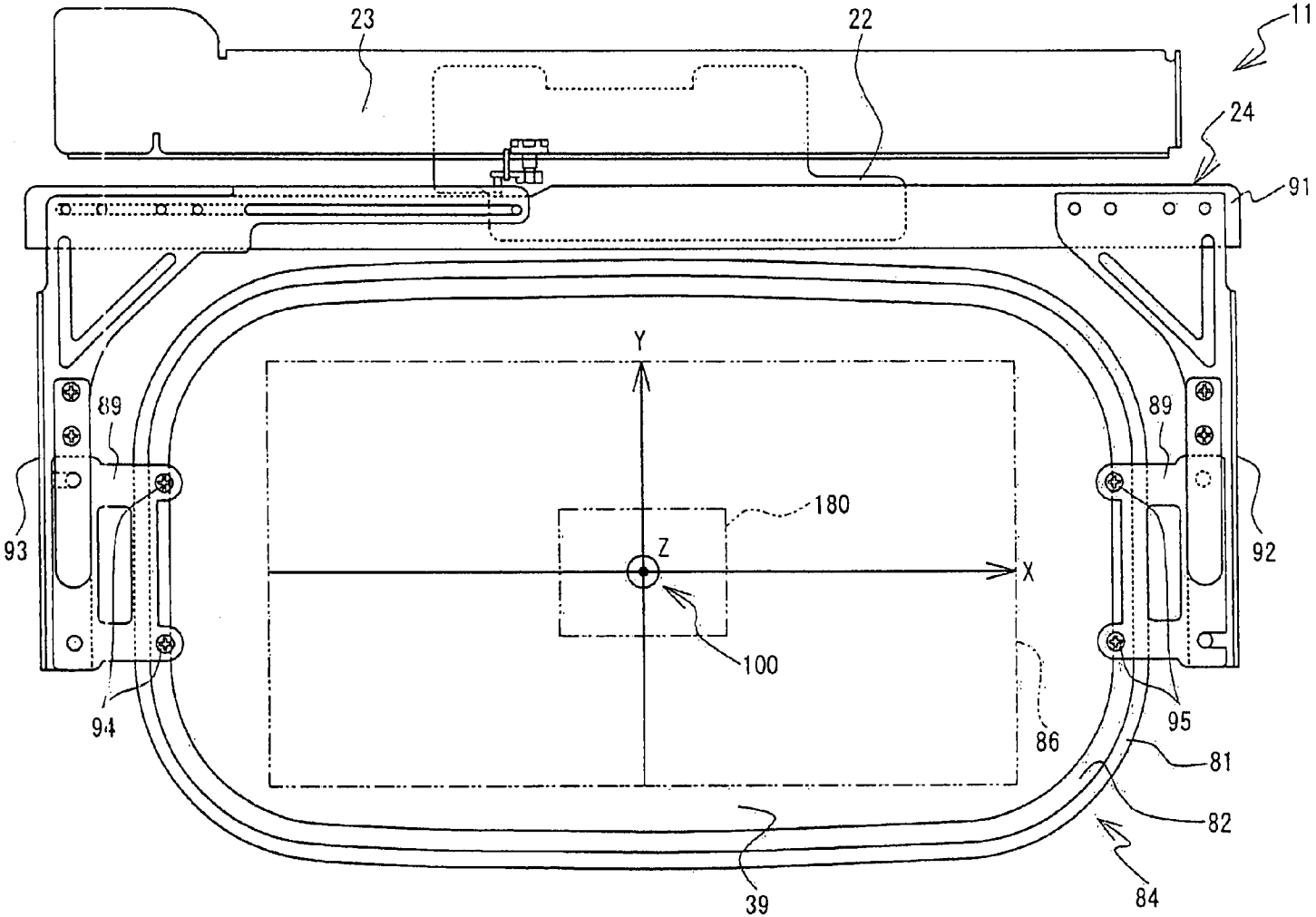
FIG. 2 is a plan view of an embroidery frame movement mechanism 11 that holds an embroidery frame 84.

As shown in FIG. 2, in the embroidery coordinate system 100, a direction from the left toward the right of the sewing machine 1 is an X-axis plus direction, and a direction from the front toward the rear of the sewing machine 1 is a Y-axis plus direction. In the present embodiment, an initial position of the embroidery frame 84 is set as the origin (X, Y, Z)=(0, 0, 0) of the embroidery coordinate system 100. The initial position of the embroidery frame 84 is a position at which a center point of the sewable area 86 corresponding to the embroidery frame 84 matches a needle drop point. The needle drop point is a point at which the needle 35 (refer to FIG. 3) disposed vertically above the needle hole 36 (refer to FIG. 1) pierces the sewing target object 39 when the needle bar 31 is moved downwardly from above the sewing target object 39. The embroidery frame movement mechanism 11 of the present embodiment does not cause the embroidery frame 84 to move in a Z direction (the up-down direction of the sewing machine 1). Therefore, if the thickness of the sewing target object 39 is within a negligible range, the Z coordinate of an upper surface of the sewing target object 39 is set to zero.

Coordinate data of the sewing data stored in the ROM 62 defines an initial layout of the embroidery pattern. The initial layout of the embroidery pattern is set such that a center point of the embroidery pattern matches the origin (the center point of the sewable area 86) of the embroidery coordinate system 100. The coordinate data of the sewing data is appropriately corrected when the layout of the embroidery pattern with respect to the sewing target object 39 is changed. In the present embodiment, the layout of the embroidery pattern with respect to the sewing target object 39 is set in accordance with the main processing, which will be described later. In the explanation below, the position of the embroidery pattern (more precisely, the center point of the embroidery pattern) and the angle of the embroidery pattern are set with respect to the sewing target object 39 held by the embroidery frame 84, using data represented by the embroidery coordinate system 100.

An image capturing range of the image sensor 50 (refer to FIG. 3) will be explained with reference to FIG. 2. When the image sensor 50 is disposed in an image capturing position, an image capturing range of the image sensor 50 in an X-Y plane of the embroidery coordinate system 100 is a rectangular range centered on a point that is directly below the center of the lens of the image sensor 50. A length of the rectangular range in the left-right direction is approximately 80 mm, and a length in the front-rear direction is approximately 60 mm. The image capturing position of the present embodiment is a position at which the center of the lens of the image sensor 50 is disposed directly above the needle hole 36. When the image sensor 50 is disposed in the image capturing position and the embroidery frame 84 is disposed in the initial position, an image capturing range 180 is a rectangular range centered on the origin of the embroidery coordinate system 100 as shown in FIG. 2.

Figure 4:
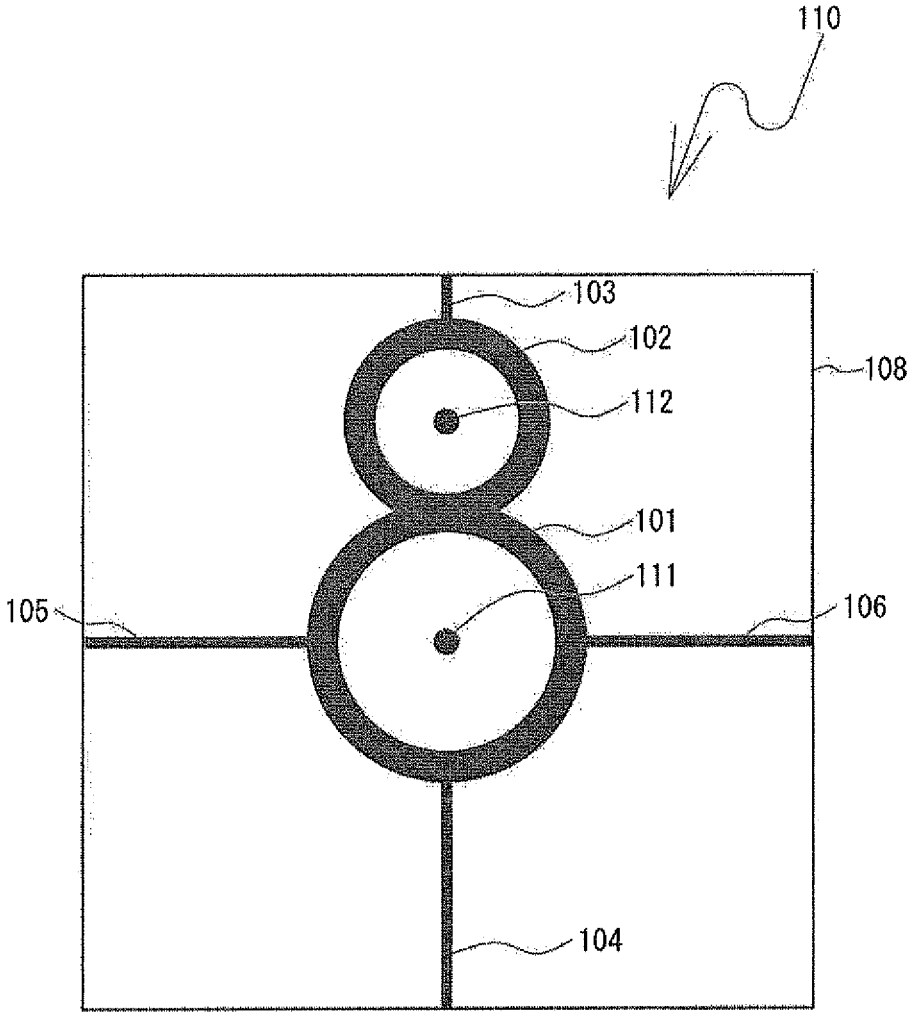
FIG. 4 is a plan view of a marker 110.

A marker 110 will be explained with reference to FIG. 4. The explanation will be made assuming that the upper side, the lower side, the left side and the right side of FIG. 4 respectively correspond to the upper side, the lower side, the left side and the right side of the pattern drawn in the marker 110. The marker 110 is made such that the pattern is drawn on an upper surface of a white base sheet 108 having a thin plate shape. The base sheet 108 has a square shape in which the length is 2.5 cm and the width is 2.5 cm, for example. A first circle 101, a second circle 102, a first center point 111 and a second center point 112 are drawn on the upper surface of the base sheet 108. The second circle 102 is arranged above the first circle 101. The diameter of the second circle 102 is smaller than the diameter of the first circle 101, The first center point 111 is the center of the first circle 101. The second center point 112 is the center of the second circle 102. Further, line segments 103 to 106 are drawn on the upper surface of the base sheet 108. The line segment 103 and the line segment 104 overlap with a virtual line (not shown in the drawings) that passes through the first center point 111 and the second center point 112. The line segment 105 and the line segment 106 overlap with a virtual line (not shown in the drawings) that passes through the first center point 111 of the first circle 101 and that is orthogonal to the line segment 103. The line segments 103 to 106 are respectively drawn to the outer edges of the base sheet 108.

A transparent adhesive is applied to a back surface of the base sheet 108. It is therefore possible to adhere the base sheet 108 onto the sewing target object 39. Normally, the base sheet 108 is adhered to a release paper (not shown in the drawings). The user peels the base sheet 108 from the release paper to uses the base sheet 108.

The main processing that is performed by the CPU 61 of the sewing machine 1 will be explained with reference to FIG. 5 to FIG. 17. The CPU 61 develops, on the RAM 63, the program stored in the ROM 62 and thereby functions as an example of a processor that performs the main processing. Note that, in place of the CPU 61, a micro computer, application specific integrated circuits (ASIC), a field programmable gate array (FPGA) or the like may be used as the processor. In the main processing of the present embodiment, when a plurality of patterns are sewn on the sewing target object 39 in a range larger than the sewable area 86, sewing is performed while changing the holding position of the sewing target object 39. More specifically, the sewable area 86 is set inside the embroidery frame 84 (refer to FIG. 2), and the sewing target object 39 is held by the embroidery frame 84. When sewing is performed, the layout between the patterns is adjusted in accordance with a command from the user, and positioning between the patterns is performed. Hereinafter, of the two patterns that are continuously sewn in a state in which the holding positions of the sewing target object 39 by the embroidery frame 84 are different from each other, the pattern that is sewn first is also referred to as a first pattern. The pattern that is sewn next is also referred to as a second pattern. The holding position in which the first pattern is sewn is referred to as a first holding position. The holding position in which the second pattern is sewn is referred to as a second holding position. The processing will be explained using an example in which patterns 151 and 152 shown in FIG. 6 are arranged as the first pattern and the second pattern in accordance with a command input by the user and are sewn sequentially.

Figure 5:
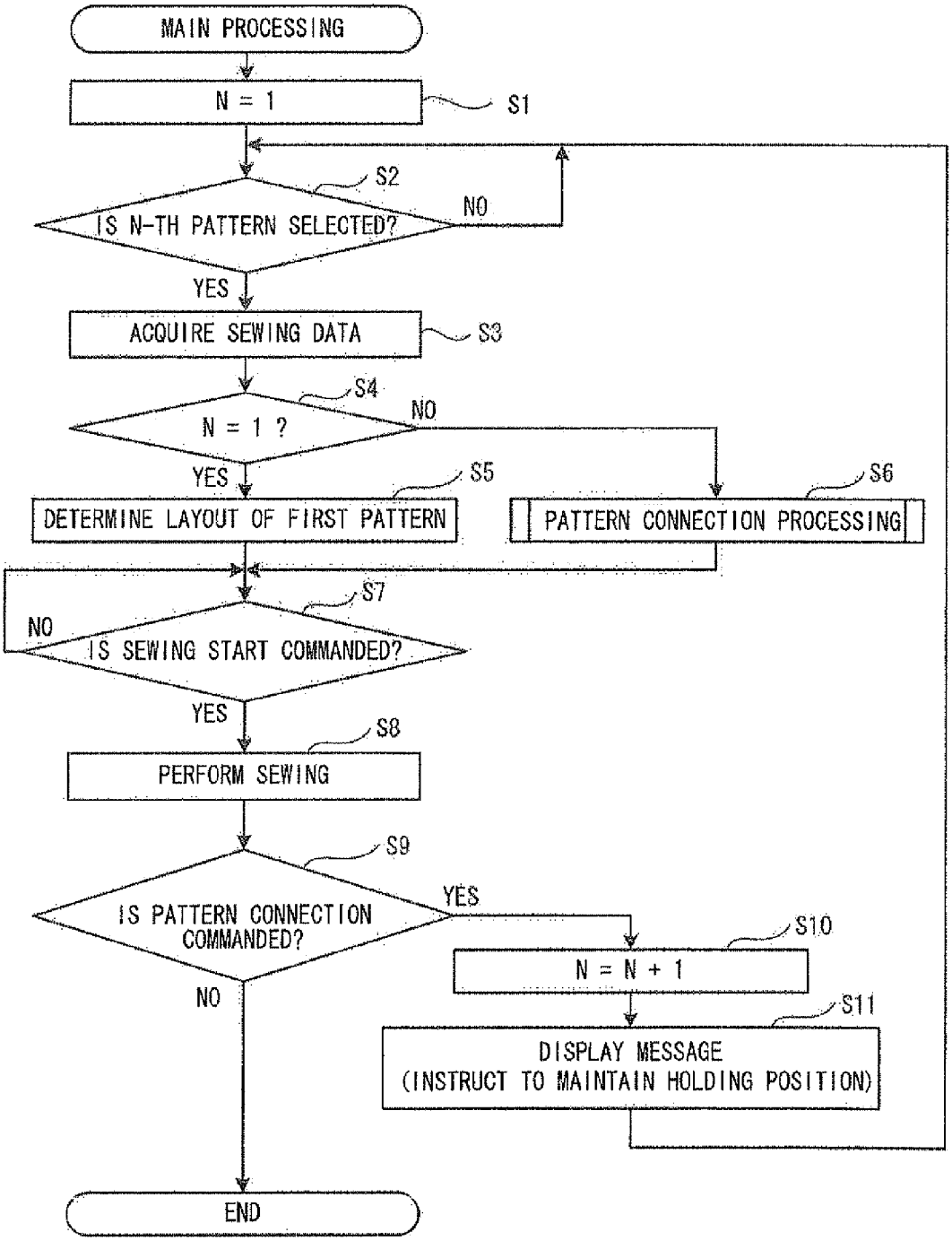
FIG. 5 is a flowchart of main processing.
Figure 6:
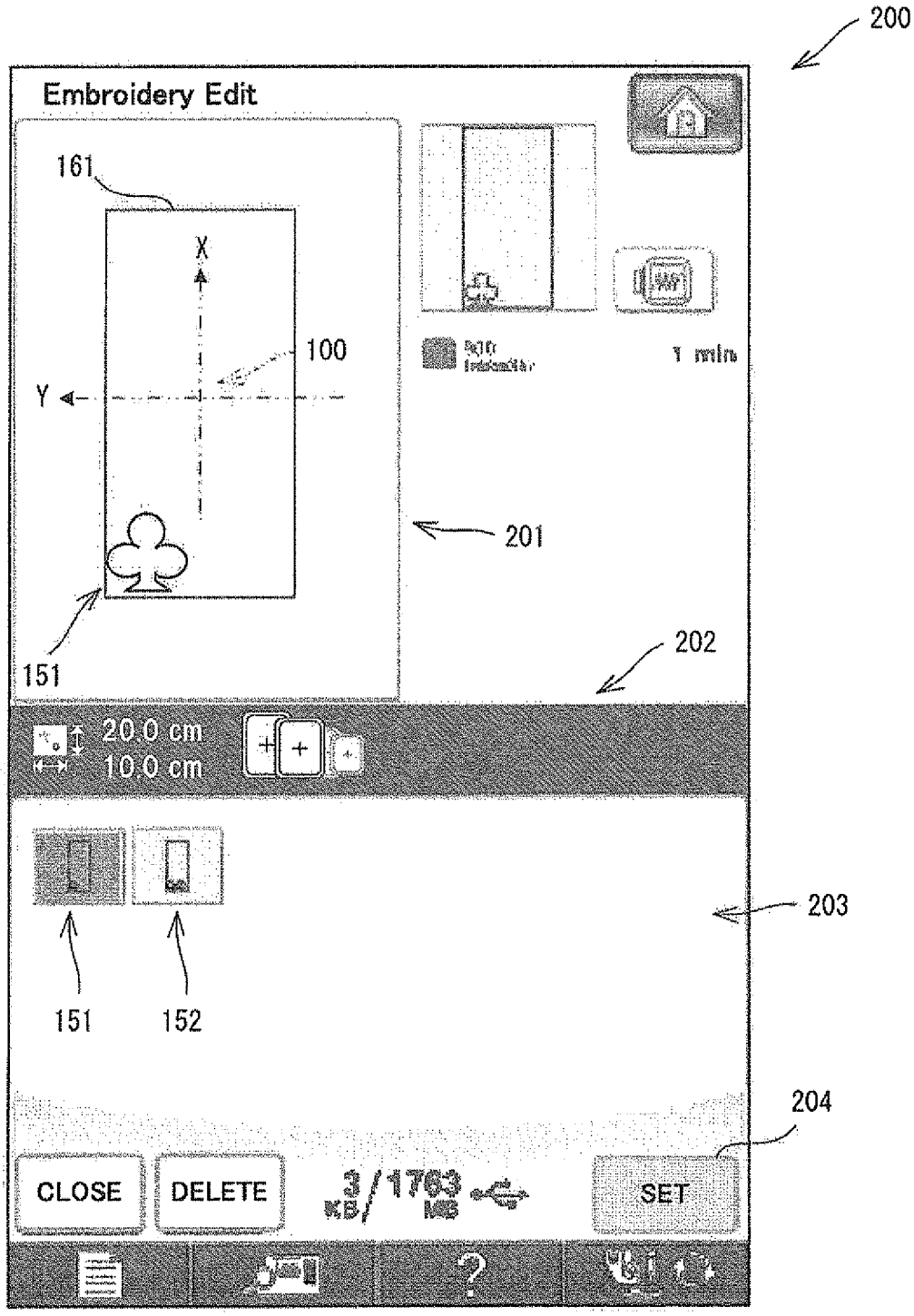
FIG. 6 is an explanatory diagram of a selection screen 200.

The main processing shown in FIG. 5 is performed when the user inputs a command to start the main processing. The command to start the main processing is input by a panel operation, for example. The program to perform the main processing is stored in the ROM 62 (refer to FIG. 3) and is performed by the CPU 61. In the explanation below, an image based on image data generated by the image sensor 50 is referred to as a captured image. Various screens and messages shown as examples are displayed on the LCD 7 when a control signal is output to the drive circuit 135. In the various screens that are shown as examples, the left-right direction and the up-down direction of the drawings are respectively referred to as the left-right direction and the up-down direction of the screens.

In the main processing, first, a variable N is set to 1 and the set variable N is stored in the RAM 63 (step S1). The variable N is a variable to count the number of the patterns selected by the user. The variable N corresponds to a sewing order of the selected patterns. The CPU 61 stands by until an N-th pattern is selected (NO at step S2, step S2). At step S2, first, a selection screen 200 exemplified in FIG. 6 is displayed on the LCD 7. The selection screen 200 includes, for example, a pattern display column 201, a pattern information column 202, a pattern selection column 203 and a SET key 204.

The size of the pattern display column 201 corresponds to the size of the sewable area 86 that is set in accordance with the attached embroidery frame 84. The up-down direction of the pattern display column 201 corresponds to the X-axis direction of the embroidery coordinate system 100. The left-right direction of the pattern display column 201 corresponds to the Y-axis direction of the embroidery coordinate system 100. In the pattern display column 201, a currently selected pattern is displayed together with a graphic that represents the range in which the currently selected pattern is sewn. In the present embodiment, the graphic that represents the range in which the pattern is sewn is shown by a rectangle 161. In a state in which the pattern is in an initial layout, the rectangle 161 that represents the range in which the pattern is sewn includes sides that are parallel in the left-right direction of the pattern display column 201, and sides that are parallel in the direction perpendicular to the up-down direction of the pattern display column 201. The size of the rectangle 161 and the attached embroidery frame 84, for example, are displayed in the pattern information column 202.

A plurality of patterns (the patterns 151 and 152, in the example of FIG. 6) that can be sewn by the sewing machine 1 are displayed in the pattern selection column 203 based on the sewing data stored in the ROM 62 or the EEPROM 64. The user selects, from among these patterns, a desired pattern (the pattern 151, for example) by a panel operation. After the selection, if the SET key 204 is selected, it is determined that the N-th pattern is selected (YES at step S2). The sewing data corresponding to the selected N-th pattern is acquired from the ROM 62 or the EEPROM 64 and the acquired sewing data is stored in the RAM 63 (step S3).

Figure 7:
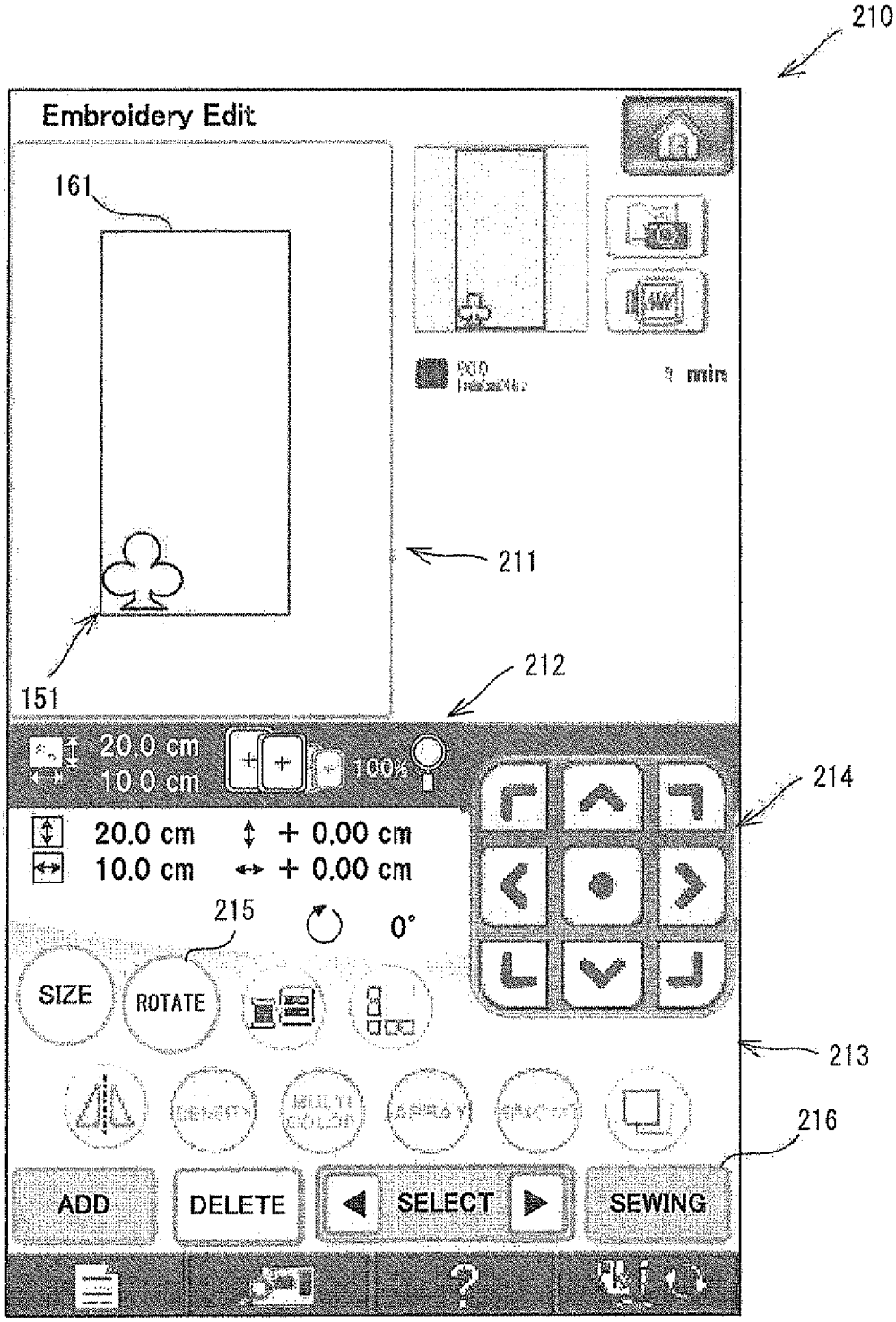
FIG. 7 is an explanatory diagram of an editing screen 210.

In the initial processing, the variable N is 1 (YES at step S4). Therefore, the layout of the first pattern in the embroidery coordinate system 100 is determined (step S5). More specifically, the sewing data of the first pattern (the pattern 151) acquired at step S3 is edited based on a command from the user. The edited sewing data is corrected by a known method and the layout of the first pattern 151 with respect to the sewing target object 39 in the first holding position is determined. At step 5, first, an editing screen 210 exemplified in FIG. 7 is displayed. The editing screen 210 includes, for example, a pattern display column 211, a pattern information column 212 and a pattern editing column 213. The pattern display column 211 is similar to the pattern display column 201.

The pattern editing column 213 includes various types of keys to command editing of the pattern, such as a group of movement keys 214 including eight direction keys, a ROTATE key 215 and the like. The user can command the pattern editing by selecting the keys displayed in the pattern editing column 213 through panel operations. For example, the user can move the pattern by a desired amount of movement from the initial layout by operating one of the eight direction keys included in the group of movement keys 214. By selecting the ROTATE key 215, the user can rotate the pattern by a desired angle from the initial layout, around the center point of the pattern on the displayed screen (not shown in the drawings). In addition, the user can also perform editing to change the size of the pattern, reverse the pattern and the like, via the editing screen 210. The commanded amount of movement and the rotation angle are also displayed in the pattern information column 212.

Figure 8:
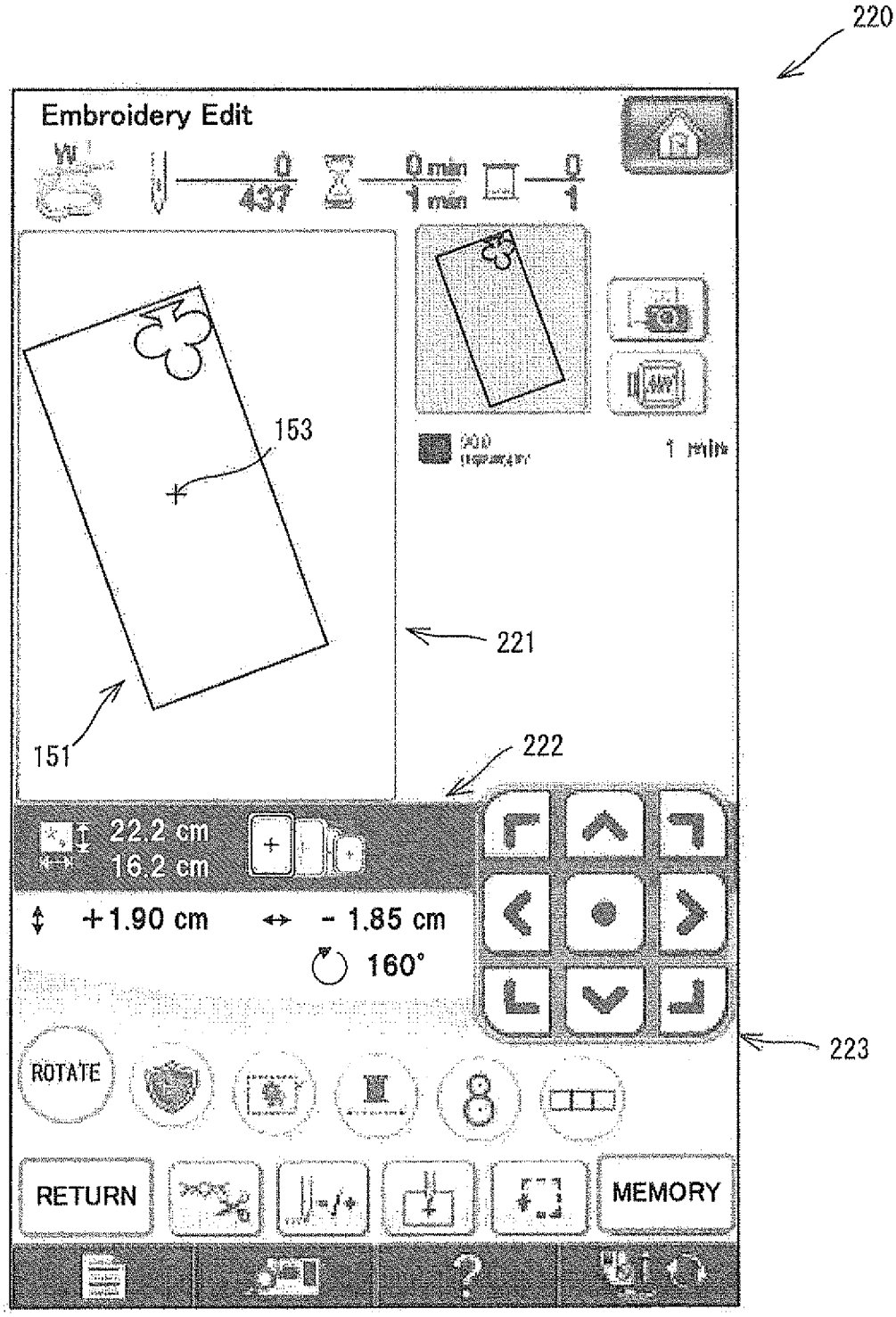
FIG. 8 is an explanatory diagram of a sewing screen 220.

After editing the pattern, if the user selects a SEWING key 216 provided on the lower right side of the pattern editing column 213, editing content that has been commanded so far is ascertained, and the sewing data of the pattern is corrected by a known method and stored in the RAM 63. Then, a sewing screen 220 exemplified in FIG. 8 is displayed. The sewing screen 220 includes a pattern display column 221, a pattern information column 222 and a command column 223. The pattern (the pattern 151, in the example of FIG. 8) reflecting the editing content, such as the movement and the rotation etc., is displayed in the pattern display column 221, together with a cross (a cross 153, in the example shown in FIG. 8) indicating the center point of the pattern. The pattern information column 222 is similar to the pattern information column 212. In the example shown in FIG. 8, since the pattern 151 has been edited (moved and rotated), the pattern display column 221 and the pattern information column 222 display information that reflects the editing. The command column 223 includes a RETURN key to return to the previous screen and a MEMORY key to store the edited pattern in the EEPROM 64, for example.

When the user confirms the edited pattern displayed in the pattern display column 221 of the sewing screen 220 and continuously performs sewing, the user inputs a sewing start command by depressing the start/stop switch 41 (refer to FIG. 1). The CPU 61 stands by until the sewing start command is input (NO at step S7, step S7). When the CPU 61 detects the input of the sewing start command (YES at step S7), sewing of the N-th pattern is performed (step S8). Specifically, a control signal is output to the drive circuits 131 and 133 in accordance with the sewing data of the N-th pattern that has been corrected as appropriate at step S5, and the embroidery frame 84 is moved. A control signal is output to the drive circuit 121 and the drive shaft motor 122 may be driven. With the above-described operations, stitches of the pattern are formed on the sewing target object 39 held by the embroidery frame 84.

When the sewing is completed, a message, an OK key and a CANCEL key are displayed (not shown in the drawings) overlapped on the command column 223 of the sewing screen 220. The message notifies the user that the sewing is completed, and inquires whether to sew the next pattern to be connected. When the user wants to sew an (N+1)-th pattern continuously to the N-th pattern for which the sewing is completed and the whole pattern including the N-th pattern and the (N+1)-th pattern does not fall within the sewable area 86, the user selects the OK key in order to perform pattern connection processing. On the other hand, when the CANCEL key is selected or the OK key is not selected for a predetermined time period (for five minutes, for example), it is determined that the pattern connection processing is not commanded (NO at step S9) and the main processing ends.

When the OK key is selected and it is determined that the pattern connection processing is commanded (YES at step S9), the variable N is incremented by 1 and the incremented variable N is stored in the RAM 63 (step S10). Further, although not shown in the drawings, the following two messages are displayed on the LCD 7 (step S11). One of the messages is a message that instructs the user not to change the holding position of the sewing target object 39 with respect to the embroidery frame 84, namely, not to remove the sewing target object 39 from the embroidery frame 84. The other message is a message that prompts the user to select the next pattern (the second pattern). The processing returns to step S2 and the selection screen 200 exemplified in FIG. 6 is displayed on the LCD 7. At step S2, for example, the pattern 152 is selected as the second pattern to be connected to the first pattern 151 that is arranged as shown in FIG. 8 (YES at step S2). The sewing data of the pattern 152 is acquired from the RAM 63 (step S3). Since the variable N is not 1 (NO at step S4), the pattern connection processing is performed (step S6, FIG. 9). In the pattern connection processing, a layout relationship between the first pattern and the second pattern is determined as specified by the user, and the layout of the second pattern with respect to the sewing target object 39 is determined based on images including the markers 110 before and after the change of the holding position.

Figure 9:
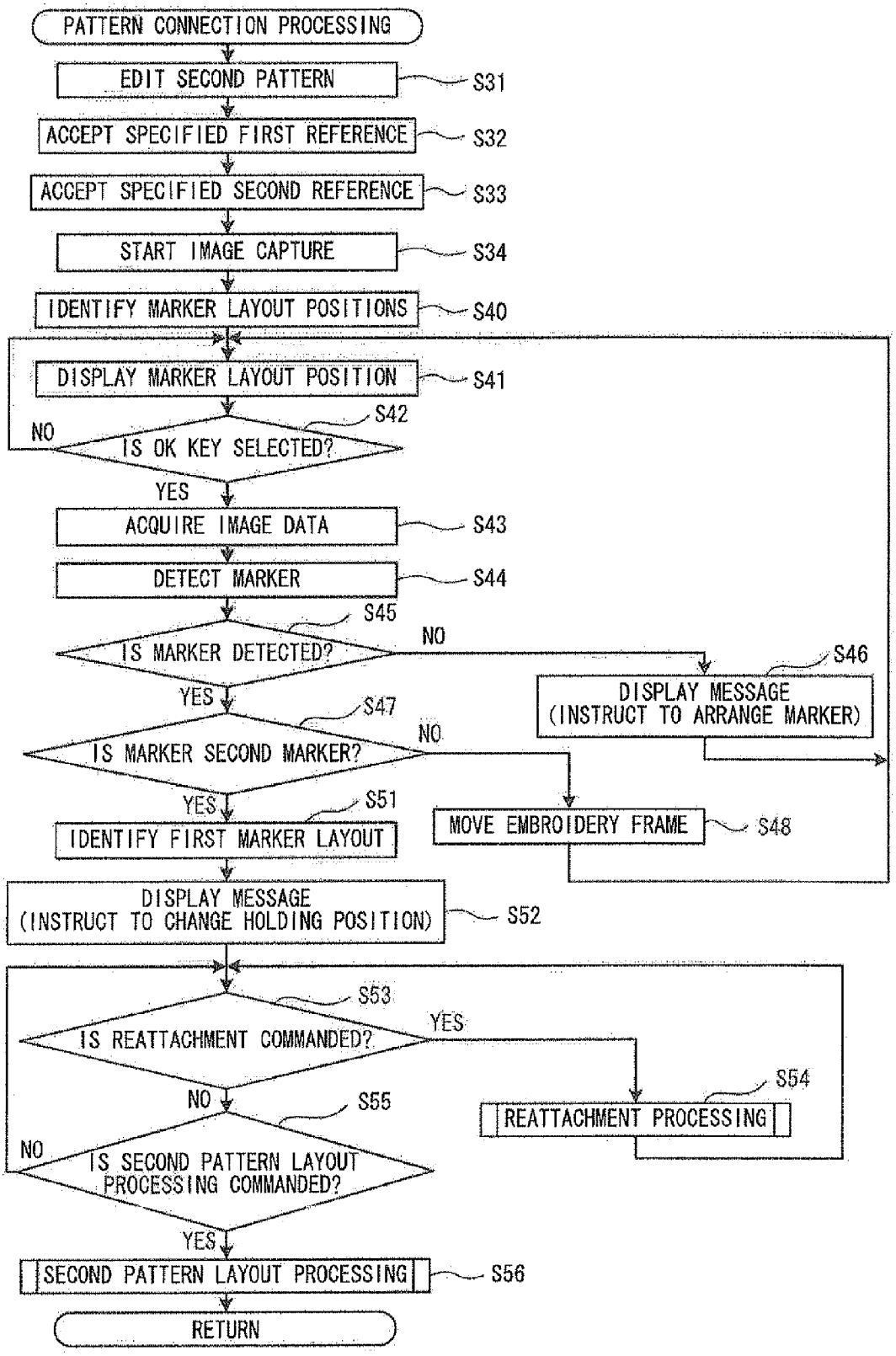
FIG. 9 is a flowchart of pattern connection processing that is performed in the main processing.

As shown in FIG. 9, in the pattern connection processing, first, the editing screen 210 that is the same as that shown in FIG. 7 is displayed on the LCD 7, and the second pattern is edited as appropriate. The sewing data acquired at step S3 is corrected based on the content of the editing, and the corrected sewing data is stored in the RAM 63 (step S31).

Figure 10:
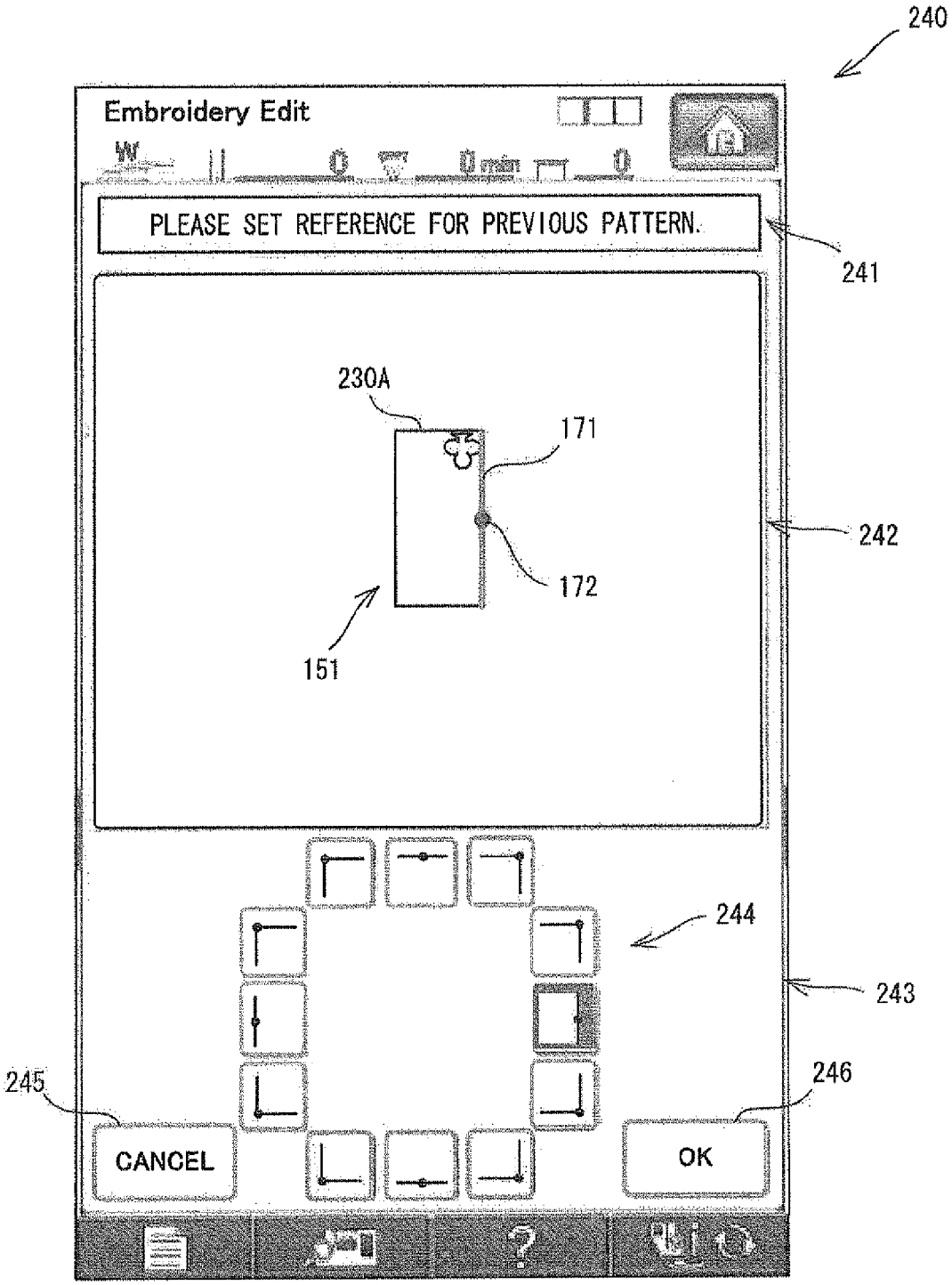
FIG. 10 is an explanatory diagram of a first reference setting screen 240.

A first reference is specified and accepted (step S32). The first reference is a reference relating to the first pattern. The first reference is used when a relative layout relationship between the first pattern and the second pattern is determined. At step S32, first, a first reference setting screen 240 exemplified in FIG. 10 is displayed on the LCD 7. As shown in FIG. 10, the first reference setting screen 240 includes a message 241, a pattern display column 242 and a command column 243. The message 241 prompts the user to set the first reference. The first reference includes, for example, at least one of a first line segment 171 and a first point 172 specified by the user. The first reference of the present embodiment includes both the first line segment 171 and the first point 172. The first line segment 171 is selected from among four sides of a smallest rectangle 230A. The smallest rectangle 230A represents a range in which the first pattern (an (N−1)-th pattern) is to be sewn. The first pattern can be arranged within the smallest rectangle 230A. The first point 172 is selected from among both end points of the first line segment 171 and a midpoint of the first line segment 171.

The command column 243 includes a group of first specifying keys 244, a CANCEL key 245 and an OK key 246. Twelve first specifying keys included in the group of first specifying keys 244 are used to specify the above-described first reference. In the present embodiment, a combination of the first line segment 171 and the first point 172 is selected as the first reference. The combination corresponds to the key selected by the user from among the first specifying keys included in the group of first specifying keys 244. In the pattern display column 242, the first line segment 171 and the first point 172 corresponding to the selected first specifying key are displayed in an overlapping manner on the first pattern and the smallest rectangle 230A. In the example shown in FIG. 10, the first reference corresponding to the pattern 151, which is the first pattern, is specified such that the right side of the smallest rectangle 230A is specified as the first line segment 171 and the midpoint of the first line segment 171 is specified as the first point 172. Note that, as shown in FIG. 8, when the first pattern is rotated by editing, the first pattern is displayed in the pattern display column 242 at an angle of 0 degrees, 90 degrees, 180 degrees or 270 degrees, namely whichever is closest to the rotated angle. In the case of the pattern 151, since the pattern 151 is rotated 160 degrees in the clockwise direction, the pattern 151 is displayed in a state in which the pattern 151 is rotated 180 degrees in the clockwise direction.

The CANCEL key 245 of the command column 243 is selected when redoing the specification of the first reference. The OK key 246 is selected when the specified first reference is confirmed. When the user specifies the first reference on the first reference setting screen 240 and confirms the first reference by selecting the OK key 246, the specified first reference is stored in the RAM 63. The layout of the first reference (the first line segment 171 and the first point 172) in the smallest rectangle 230A that corresponds to the first pattern can be identified based on the sewing data (the corrected sewing data, in a case where the first pattern has been edited and the sewing data has been corrected) of the first pattern. The layout of the first line segment 171 and the first point 172 identified by the coordinates of the embroidery coordinate system 100 is stored in the RAM 63.

Figure 11:
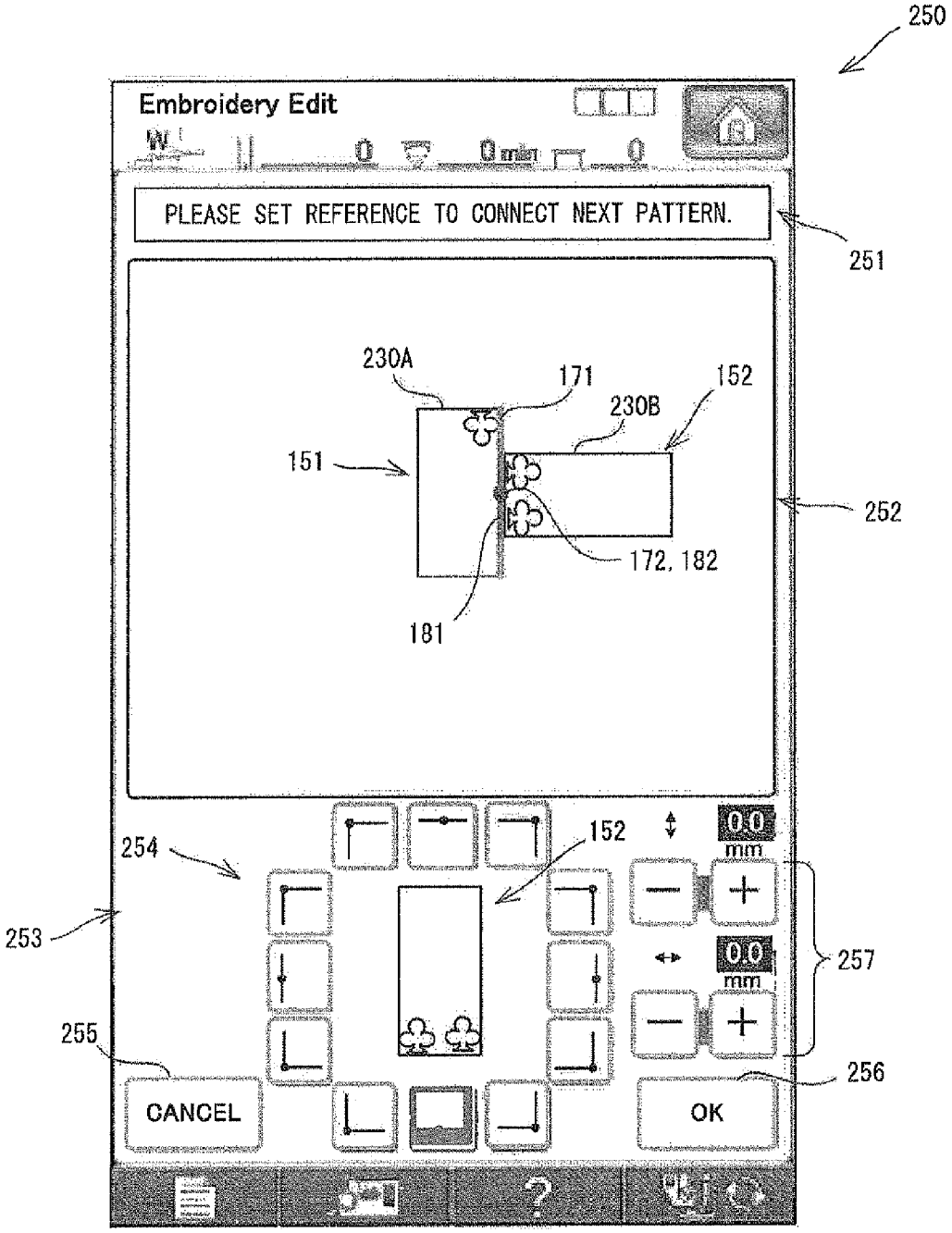
FIG. 11 is an explanatory diagram of a second reference setting screen 250.

A second reference is specified and accepted (step S33). The second reference is a reference relating to the second pattern. The second reference is used when the relative layout relationship between the first pattern and the second pattern is determined. At step S33, first, a second reference setting screen 250 exemplified in FIG. 11 is displayed on the LCD 7. As shown in FIG. 11, the second reference setting screen 250 includes a message 251, a pattern display column 252 and a command column 253. The message 251 prompts the user to set the second reference. The second reference includes, for example, at least one of a second line segment 181 and a second point 182 specified by the user. The second reference of the present embodiment includes both the second line segment 181 and the second point 182. The second line segment 181 is selected from among four sides of a smallest rectangle 230B. The smallest rectangle 230B represents a range in which the second pattern (the N-th pattern) is to be sewn. The second pattern can be arranged within the smallest rectangle 230B. The second point 182 is selected from among both end points of the second line segment 181 and a midpoint of the second line segment 181.

The command column 253 includes a group of second specifying keys 254, a group of movement keys 257, a CANCEL key 255 and an OK key 256. Twelve second specifying keys included in the group of second specifying keys 254 are used to specify the above-described second reference. In the present embodiment, a combination of the second line segment 181 and the second point 182 is selected as the second reference. The combination corresponds to the key selected by the user from among the second specifying keys included in the group of second specifying keys 254. The pattern to be sewn next (the second pattern) is displayed in a central portion of the group of second specifying keys 254 that are arranged in a rectangular shape. In a case where the second pattern has been edited at step S31, the second pattern is displayed in a state in which the content of the editing is reflected. An X-axis direction key and a Y-axis direction key included in the group of movement keys 257 are respectively selected when the position of the second reference with respect to the first reference is to be moved in the X-axis direction and the Y-axis direction.

The first pattern, the smallest rectangle 230A, the second pattern, the smallest rectangle 230B and the second reference are displayed in the pattern display column 252. The first line segment 171 and the first point 172 are displayed in the smallest rectangle 230A in an overlapping manner. Based on the second reference specified using the second specifying key, the second pattern and the smallest rectangle 230B are arranged with respect to the first pattern and the smallest rectangle 230A. More specifically, as a general rule, the first pattern and the second pattern are arranged such that the extending direction of the first line segment 171 overlaps with the second line segment 181 and the first point 172 overlaps with the second point 182. When a command that causes the position of the second reference with respect to the first reference to move in the X-axis direction or the Y-axis direction is input using the group of movement keys 257, the second reference is moved in accordance with the specified amount of movement. In this case, the first pattern and the second pattern do not necessarily overlap with each other. In the example shown in FIG. 11, the pattern 152, which is the second pattern, is not edited. The second reference is specified such that the lower side of the smallest rectangle 230B is specified as the second line segment 181 and the midpoint of the second line segment 181 is specified as the second point 182. In the pattern display column 252, the patterns 151 and 152 are arranged such that the pattern 152 is overlapped with the pattern 151 that has been rotated 180 degrees in the clockwise direction. More specifically, the patterns 151 and 152 are arranged such that the lower side (the second line segment 181) of the smallest rectangle 23013 of the pattern 152 overlaps with the right side (the first line segment 171) of the smallest rectangle 230A and the midpoint (the second point 182) of the lower side of the smallest rectangle 230B overlaps with the midpoint (the first point 172) of the right side of the smallest rectangle 230A.

The CANCEL key 255 of the command column 253 is selected when redoing the specification of the second reference. The OK key 256 is selected when the specified second reference is confirmed. When the user specifies the second reference on the second reference setting screen 250 and confirms the second reference by selecting the OK key 256, the specified second reference is stored in the RAM 63. The layout of the second reference (the second line segment 181 and the second point 182) in the smallest rectangle 230B that corresponds to the second pattern can be identified based on the sewing data (the corrected sewing data, in a case where the second pattern has been edited and the sewing data has been corrected) of the second pattern. The layout of the second line segment 181 and the second point 182 identified by the coordinates of the embroidery coordinate system 100 is stored in the RAM 63 in association with the first reference identified at step S32. With the above processing, the layout relationship of the second pattern with respect to the first pattern is determined. At this time, the holding position of the sewing target object 39 by the embroidery frame 84 is the first holding position because the holding position has not been changed from the holding position set when the first pattern was sewn.

After the embroidery frame 84 is moved to the image capturing position and image capture of the vicinity of the needle hole 36 (refer to FIG. 1) is started by the image sensor 50 (step S34), marker layout positions are identified (step S40). The marker layout positions are positions in which the markers 110 are to be arranged on the sewing target object 39 in order to accurately position the second pattern with respect to the first pattern using an image of the markers 110 when the holding position is changed from the first holding position to the second holding position and the second pattern is sewn.

In order to complete the change of the holding position from the first holding position to the second holding position by changing the holding position only once, it is desirable that the markers 110 can be arranged within the sewable area 86 in the first holding position and the markers 110 can also be arranged within the sewable area 86 in the second holding position. Therefore, in the present embodiment, positions which are within the sewable area 86 in the first holding position and which are also within an estimated range in which the second pattern is to be sewn are identified as the marker layout positions, based on the first reference and the second reference (the layout relationship of the second pattern with respect to the first pattern) specified at step S32 and step S33 and stored in the RAM 63. Since the sewable area 86 in the second holding position is set by the user, the position of the sewable area 86 varies and cannot be ascertained. On the other hand, the estimated range in which the second pattern is to be sewn is included in the sewable area 86 in the second holding position. Further, if the layout relationship of the second pattern with respect to the first pattern is determined, the position of the sewable area 86 does not vary. Therefore, in the present embodiment, the marker layout positions are identified in accordance with the above-described conditions (i.e., within the sewable area 86 in the first holding position and also within the estimated range in which the second pattern is to be sewn).

Figure 12:
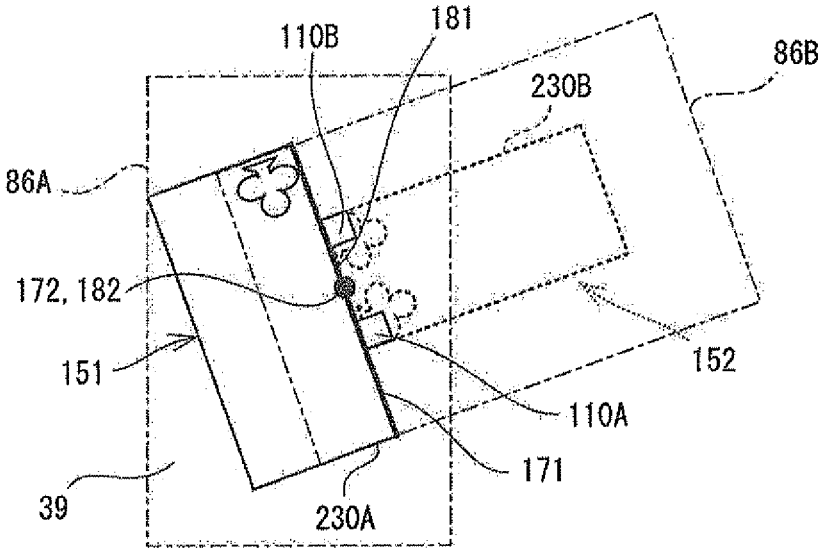
FIG. 12 is an explanatory diagram of an identification method of marker layout positions.

For example, a case will be explained in which the layout relationship between the pattern 151, which is the first pattern, and the pattern 152, which is the second pattern, has been determined as in the example shown in FIG. 11. In this case, it is sufficient that two rectangle areas 110A and 110B are identified as the marker layout positions as shown in FIG. 12. More specifically, within a sewable area 86A in the first holding position, the rectangle areas 110A and 110B are in contact with a line including the first line segment 171 of the pattern 151, and are in contact, from the inside, with corners of the above-described smallest rectangle 230B that corresponds to the pattern 152. It is preferable that the size of the rectangle areas 110A and 110B is set to be larger than that of the markers 110 (for example, 1.5 times the size of the marker 110) so that the markers 110 can be easily attached to the rectangle areas 110A and 110B. As described above, in the embroidery coordinate system 100 in the first holding position, the coordinates representing the first line segment 171 have been identified and the layout relationship between the first pattern and the second pattern has also been determined. Therefore, based on the coordinate data and on the sewing data of the pattern 152, it is also possible to identify coordinates representing the areas 110A and 110B. In the case of this example, it is possible to reliably set the second holding position such that the markers 110 can also be arranged within a sewable area 86B. Note that, as long as the first pattern and the second pattern are sewn using the same embroidery frame 84, even if the holding position is changed, the sewable area 86A and the sewable area 86B have a same shape and a same size.

Figure 13:
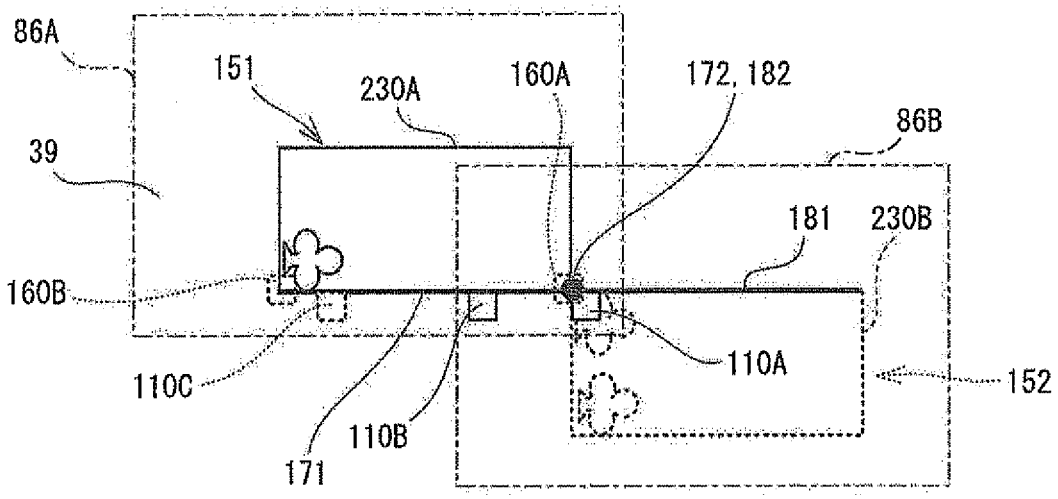
FIG. 13 is another explanatory diagram of the identification method of the marker layout positions.

Note that, depending on the layout relationship between the first pattern and the second pattern, there is a case in which the two areas 110A and 110B cannot be arranged within the sewable area 86A in the first holding position and also within the estimated range in which the second pattern is to be sewn (within the smallest rectangle 230B corresponding to the second pattern). For example, as shown in FIG. 13, when the pattern 151 and the pattern 152 are arranged side by side in an oblique direction such that they are in contact with each other at one of vertices of the smallest rectangles 230A and 230B that respectively correspond to the patterns 151 and 152, only the single area (the area 110A) can be arranged as the rectangle area that satisfies the above-described conditions. In this type of case, for example, the other rectangle area (the area 110B) may be arranged side by side with the area 110A, in a position which is within the sewable area 86A and which is in contact with the line including the first line segment 171. Note that, when the two markers 110 are used as in the present embodiment, in order to improve positioning accuracy, it is preferable to arrange the area 1108 in a position that is separated from the area 110A by a certain distance. However, in order to restrict to one the number of times the holding position is changed from the first position to the second position, the rectangle area should not be arranged in a position (for example, an area 110C shown by a dotted line) that is clearly outside the sewable area 86B, based on the layout of the pattern 152 with respect to the pattern 151 and on the size of the sewable area 86B.

When the markers 110 are arranged within the sewable area 86A in the first holding position based only on the first reference of the first pattern, without taking account of the estimated range in which the second pattern is to be sewn, the markers 110 can be arranged in rectangle areas 160A and 160B whose centers are both the ends of the first line segment 171, as shown in FIG. 13, for example. In this case, as long as the same embroidery frame 84 is used, it is not possible to set the second holding position such that the areas 160A and 1608 and the pattern 152 are all arranged within the sewable area 86B. Therefore, the number of times the holding position is changed is not restricted to one. In contrast to this, in the present embodiment, the marker layout positions are set to the areas 110A and 110B, also taking account of the estimated range (the smallest rectangle 230B) in which the pattern 152 is to be sewn. Therefore, the user can set an appropriate second holding position by changing the holding position only once.

Figure 14:
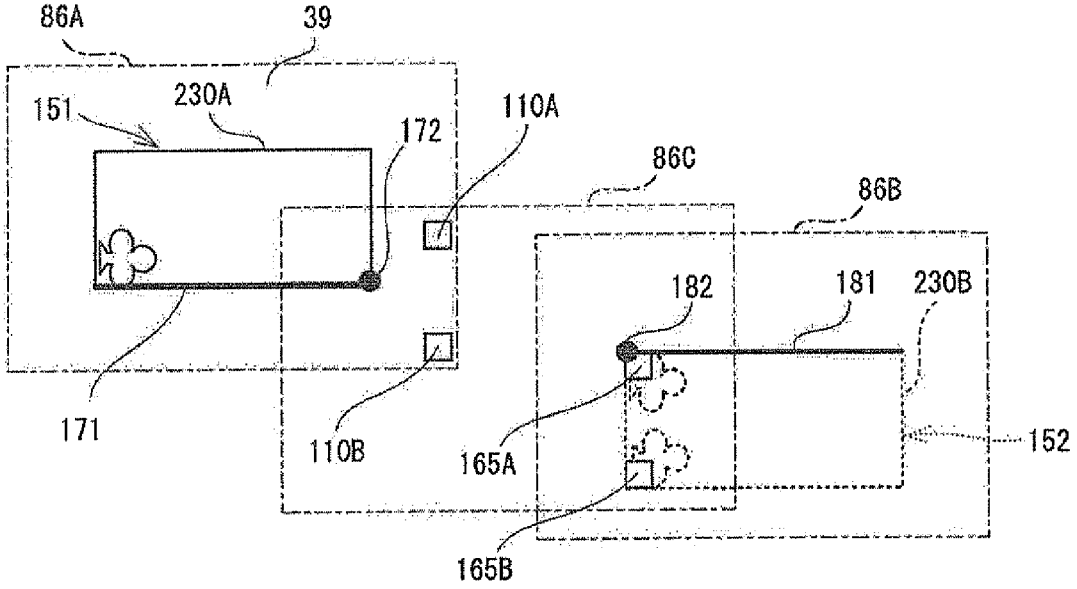
FIG. 14 is still another explanatory diagram of the identification method of the marker layout positions.

Further, if a command to move the position of the second reference with respect to the first reference is input at step S33, depending on the layout relationship between the first pattern and the second pattern, there is a case in which the estimated range (the smallest rectangle 230B) in which the second pattern is to be sewn is not included within the sewable area 86A in the first holding position, as shown in FIG. 14, for example. In this type of case, depending on attachment positions of the markers 110, it may be necessary to perform reattachment processing (step S54 of FIG. 9, FIG. 16) in which the number of times the holding position is changed is two or more, until the holding position is changed to reach the second holding position from the first holding position. To address this, when the estimated range (the smallest rectangle 230B) in which the second pattern is to be sewn is not included within the sewable area 86A in the first holding position, it is preferable that, at step S40, positions are identified as the marker layout positions such that the number of times the holding position is changed can be reduced as much as possible.

An explanation will be given using the example shown in FIG. 14. From the already determined layout relationship between the pattern 151 and the pattern 152, the estimated range (for example, coordinates representing the smallest rectangle 230B corresponding to the pattern 152) in which the pattern 152, which is the second pattern, is to be sewn can be identified in the embroidery coordinate system 100 in the first holding position. In order to reduce as much as possible the number of times the holding position is changed, it is preferable that the marker layout positions are as close as possible to the estimated range in which the pattern 152 is to be sewn. Given this, the two rectangle areas 110A and 110B which are located within the sewable area 86A in the first holding position and which are also located as close as possible to the smallest rectangle 230B that corresponds to the pattern 152 may be identified as the marker layout positions. In order to improve positioning accuracy, it is preferable to arrange the areas 110A and 110B such that they are separated from each other by a certain distance.

Figure 15:
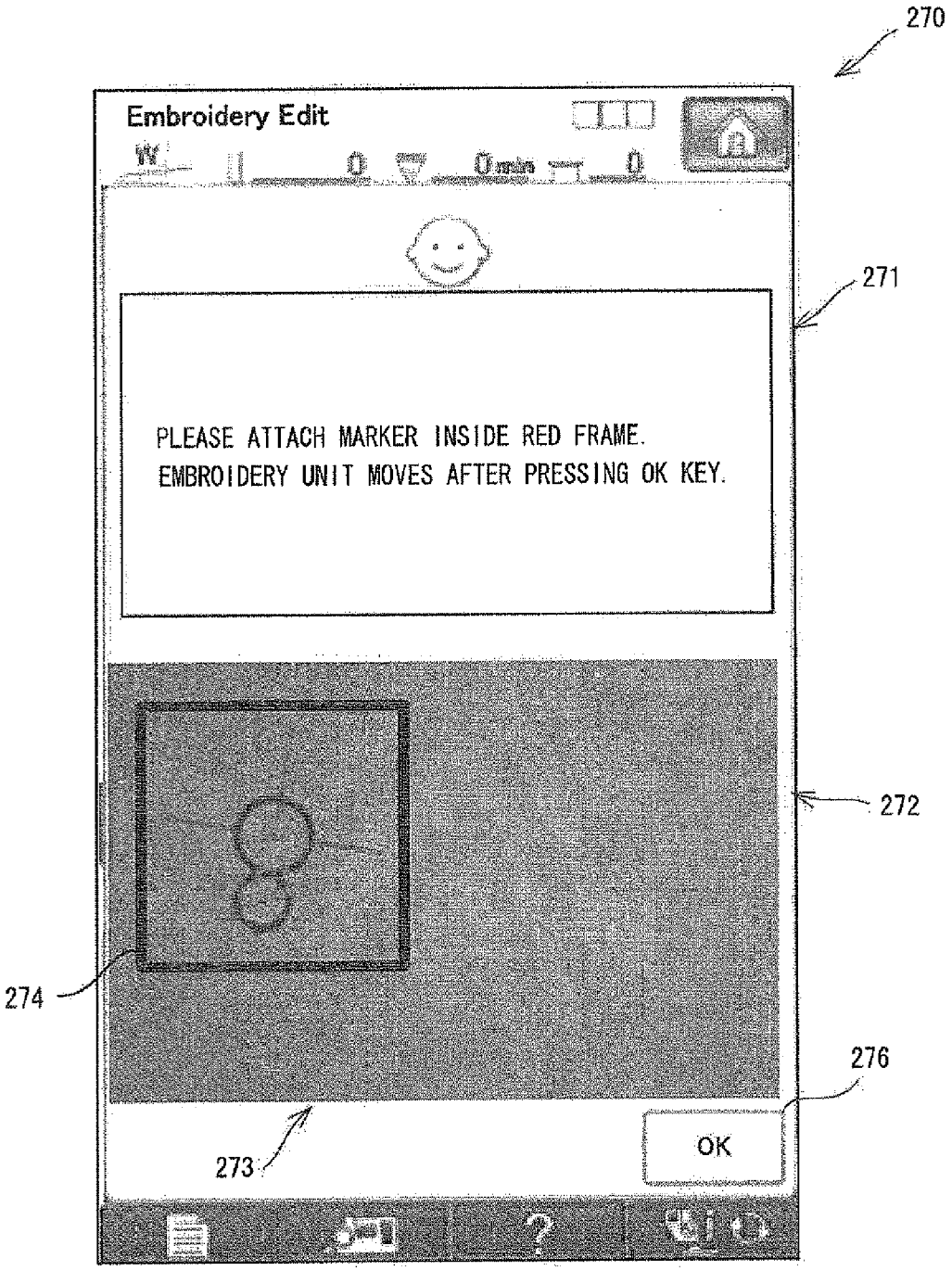
FIG. 15 is an explanatory diagram of a marker layout screen 270.

As described above, when the marker layout positions are identified at step S40, in order to perform positioning between the first pattern and the second pattern, processing is performed that detects, from images captured by the image sensor 50, the two markers 110 attached to the areas 110A and 110B, which are the above-described marker layout positions. First, based on the notification instruction from the CPU 61, the embroidery frame 84 is moved to a position in which one of the areas 110A and 110B (the area 110A, for example) falls within the image capturing range 180 (refer to FIG. 2) of the image sensor 50, and an image in which the marker layout position is identified is displayed on the LCD 7 (step S41). Specifically, a marker layout screen 270 exemplified in FIG. 15 is displayed on the LCD 7. As shown in FIG. 15, the marker layout screen 270 includes a message column 271 and a marker position display column 272.

A composite image 273 and an OK key 276 are displayed in the marker position display column 272. The composite image 273 is an image obtained by adding a red rectangle 274 to the image of the vicinity of the needle hole 36 output from the image sensor 50. In the processing that detects the first marker 110, the red rectangle 274 is displayed in a position that corresponds to one (the area 110A) of the areas 110A and 110B indicating the marker layout positions, in the image of the vicinity of the needle hole 36. The size of the rectangle 274 is approximately 1.5 times the size of the marker 110. A message that prompts the user to select the OK key 276 is displayed in the message column 271 after the marker 110 is arranged in an inside area of the rectangle 274. While confirming the marker position display column 272, the user attaches the marker 110 to the inside of the rectangle 274. As long as the OK key 276 is not selected, the processing that updates and displays the composite image 273 using the image captured by the image sensor 50 is repeated (NO at step S42, step S41).

When the user confirms that the marker 110 is attached to the inside of the rectangle 274 and selects the OK key 246 (YES at step S42), the imaging instruction is sent from the CPU 61 to the image sensor 50. Based on the imaging instruction, the image data output from the image sensor 50 is acquired and stored in the RAM 63 (step S43). Next, processing is performed that detects the marker 110 from a section of the image corresponding to the inside of the rectangle 274 (step S44). At step S44, when the marker 110 is detected from the section of the image corresponding to the inside of the rectangle 274, coordinates of the embroidery coordinate system 100 for the first center point 111 and the second center point 112 included in the marker 110 are identified.

The detection of the marker 110 and the identification of the coordinates are performed using a known method. Specifically, two-dimensional coordinates in an image coordinate system, which is a coordinate system of the image captured by the image sensor 50, are calculated for the first center point 111 and the second center point 112 of the marker 110, using Hough conversion processing, for example. After that, the two-dimensional coordinates of the image coordinate system are converted to three-dimensional coordinates of the world coordinate system. As described above, in the present embodiment, the embroidery coordinate system and the world coordinate system are associated with each other. Therefore, coordinates of the embroidery coordinate system 100 are calculated based on the three-dimensional coordinates of the world coordinate system calculated by image processing.

When the marker 110 is not detected at step S44 (NO at step S45), a message that prompts the user to arrange the marker 110 in the rectangle 274 is displayed on the LCD 7 (step S46). The processing returns to step S41. When the marker 110 is detected (YES at step S45), it is determined whether the detected marker 110 is the second marker 110 (step S47). The sewing machine 1 of the present embodiment detects the two markers 110 that are attached to the positions corresponding to the areas 110A and 110B, and associates the layout of the markers 110 with the layout of the first reference in the first holding position. Therefore, when the detected marker 110 is the first marker 110 (NO at step S47), the control signal is output to the drive circuit 131 and the drive circuit 133 and the embroidery frame 84 is moved to a position to detect the second marker 110 (step S48). Specifically, the embroidery frame 84 is moved to a position where the other area (the area 110B) that is other than the area used in the processing for the first marker 110 falls within the image capturing range of the image sensor 50.

The processing returns to step S41 and processing to detect the second marker 110 is performed (step S41 to step S46). Note that, at step S41 of the processing for the second marker 110, the red rectangle 274 is displayed in a position corresponding to the area 110B. In a similar manner, when the second marker 110 is detected (YES at step S47), the layout of the markers 110 with respect to the first reference in the first holding position is identified based on coordinates of the detected two markers 110 and on coordinates of the first reference. The identified layout of the markers 110 is stored in the RAM 63 as a first marker layout (step S51).

The layout of the markers 110 includes at least one of the position and the angle of the markers 110. The sewing machine 1 of the present embodiment detects, as the layout of the markers 110, the position and the angle of the markers 110 based on coordinates of the embroidery coordinate system of the first center points 111 of the two markers 110. The position of the markers 110 is represented, for example, by the coordinates of the embroidery coordinate system of the first center point 111 of one of the two markers 110. The angle of the markers 110 is represented by an angle formed by the X-axis of the embroidery coordinate system and a vector directing from the first center point 111 of the one of the two markers 110 toward the first center point 111 of the other marker 110. A distinction between the two markers 110 is determined based on, for example, a relative position of the second center point 112 with respect to the first center point 111 in each of the markers 110. At step S51, the layout (the position and the angle) of the markers 110 is identified by associating the coordinates of the first center points 111 (refer to FIG. 4) with the coordinates representing the first reference (the first line segment 171 and the first point 172). More specifically, the layout of the markers 110 with respect to the first reference in the first holding position is identified by associating the coordinates of the first center points 111 of the two markers 110 in the first holding position with the coordinates representing the first reference in the first holding position identified at step S32 and stored in the RAM 63.

In order to sew the next pattern (the second pattern), the LCD 7 displays a screen (not shown in the drawings) including a message and an OK key (step S52). The message prompts the user to change the holding position of the sewing target object 39 with respect to the embroidery frame 84. More specifically, the message instructs the user to remove the sewing target object 39 from the embroidery frame 84 and to re-attach the sewing target object 39. At this time, the change of the holding position is performed in a state in which the markers 110 are attached to the positions on the sewing target object 39 that correspond to the marker layout positions (the areas 110A and 110B shown in FIG. 12 to FIG. 14) specified at step S41. In other words, even when the holding position of the sewing target object 39 by the embroidery frame 84 is changed, the layout of the markers 110 with respect to the sewing target object 39 is not changed. After the OK key is selected, the LCD 7 displays a screen (not shown in the drawings) including a reattachment key that is used to command the start of the reattachment processing, and a pattern layout key that is used to command the start of second pattern layout processing that determines the layout of the next pattern (the second pattern). The CPU 61 stands by until one of the keys is selected (NO at step S53, no at step S55, step S53).

Figure 16:
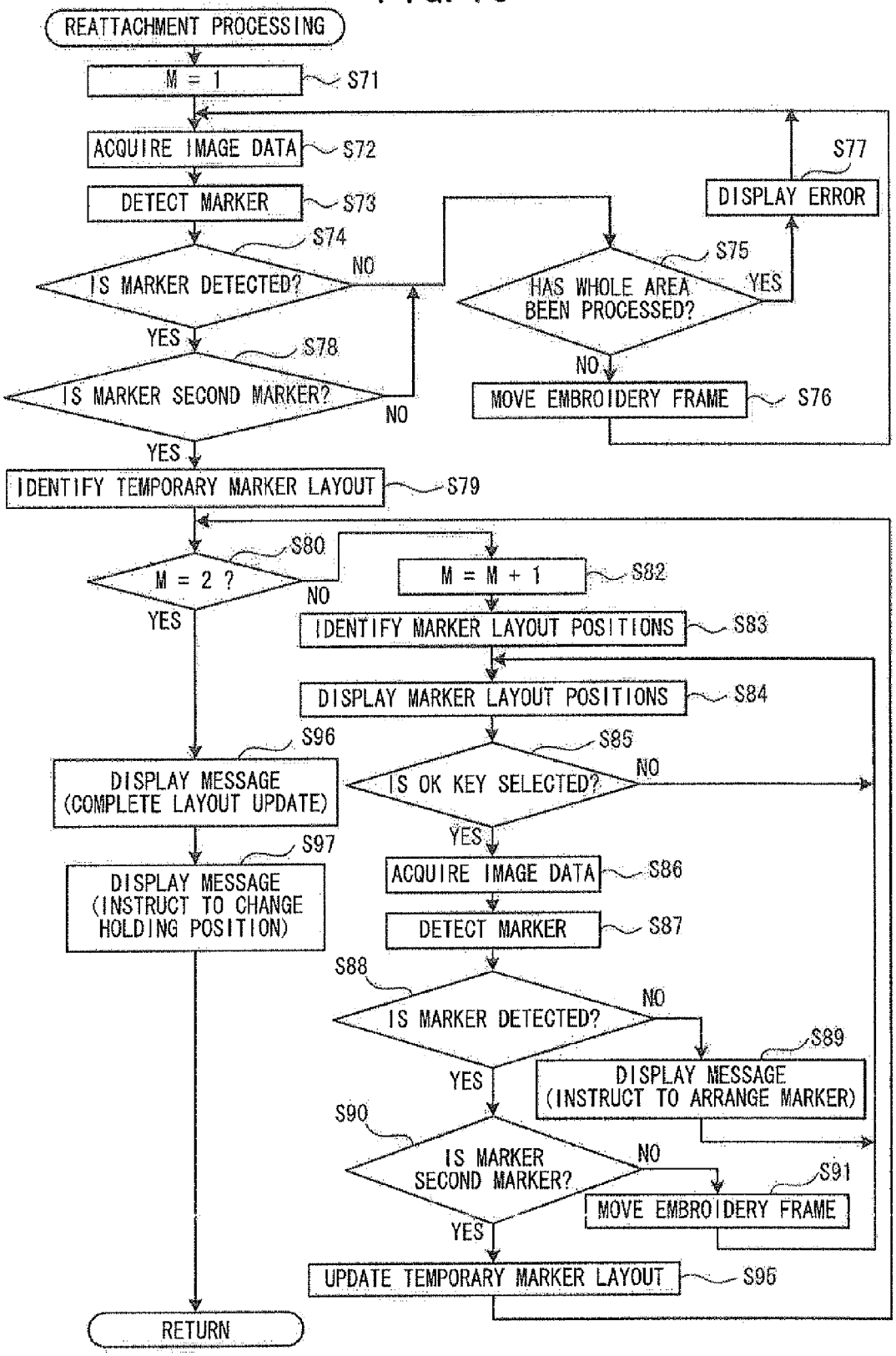
FIG. 16 is a flowchart of reattachment processing that is performed in the pattern connection processing.

When the reattachment processing is commanded by selecting the reattachment key (YES at step S53), the reattachment processing is performed (step S54, FIG. 16). As in the example shown in FIG. 14, the reattachment processing is processing in which, when it is necessary to further change the holding position before sewing the next pattern (the second pattern), the markers 110 are re-attached and the layout relationship between the first reference and the markers 110 is thereby updated. In other words, after the holding position has been changed from the first holding position, the holding position when the reattachment processing is commanded is not the second holding position in which the second pattern is sewn, but a temporary holding position that is a holding position forming a connection between the first holding position and the second holding position.

As shown in FIG. 16, in the reattachment processing, a variable M representing the number of times of detection of the marker 110 in the temporary holding position is set to 1, and the set variable M is stored in the RAM 63 (step S71). Next, taking the whole area inside the embroidery frame 84 (refer to FIG. 2) as an image capture target, first-time detection processing is performed that detects the marker 110 that remains attached to the marker layout position specified at step S41 of FIG. 9. Specifically, the image data output from the image sensor 50 is acquired (step S72), and detection processing of the marker 110 is performed by using the whole image represented by the acquired image data as a detection target (step S73). The detection of the marker 110 is performed using the known method in a similar manner to that at step S44 of FIG. 9. When the marker 110 is detected, coordinates of the embroidery coordinate system of the first center point 111 and the second center point 112 of the marker 110 are calculated, for example.

When the marker 110 is not detected (NO at step S74), the whole area inside the embroidery frame 84 is set as a detection target range and it is determined whether the processing is completed (step S75). When there is an area that has not been set as the detection target range (NO at step S75), the control signal is output to the drive circuits 131 and 133, and the embroidery frame 84 is moved to a position where the area that has not been set as the detection target range falls within the image capturing range of the image sensor 50 (step S76). The processing returns to step S72 and processing that detects the marker 110 from the image is performed. The inside area of the embroidery frame 84 is sequentially processed in this way. When the processing is completed for the whole area without detecting the marker 110 (YES at step S75), an error message informing that the two markers 110 cannot be detected is displayed on the LCD 7 (step S77). In this case, the user confirms whether the two markers 110 are located in the inside area of the embroidery frame 84. The processing returns to step S72 and the processing that detects the marker 110 from the image is performed.

When the marker 110 is detected (YES at step S74), it is determined whether the detected marker 110 is the second marker 110 (step S78). When the detected marker 110 is not the second marker 110 (NO at step S78), the processing proceeds to step S75. As described above, until the marker 110 is detected, the image is acquired in the inside area of the embroidery frame 84 by moving the embroidery frame 84, and processing that detects the second marker 110 is performed. When the processing is repeated and the second marker 110 is detected (YES at step S78), the processing proceeds to step S79. The layout of the markers 110 before reattachment (in the example shown in FIG. 14, the markers 110 attached to the positions corresponding to the areas 110A and 110B) with respect to the first reference in the temporary holding position is identified based on the coordinates of the detected two markers 110 and on the coordinates of the first reference. The identified layout of the markers 110 is stored in the RAM 63 as a temporary marker layout (step S79). Note that, at step S79, the first marker layout that has already been stored in the RAM 63 is updated to the newly identified temporary marker layout.

For example, in the first holding position corresponding to the sewable area 86A shown in FIG. 14, the layout of the markers 110 attached to the positions corresponding to the areas 110A and 110B with respect to the first reference (the first line segment 171 and the first point 172) has already been identified. Further, when the sewing target object 39 is reattached in the temporary holding position that corresponds to a sewable area 86C, the embroidery coordinate system 100 in the temporary holding position is set and the origin is known. At step S73 of the above-described reattachment processing, the coordinates of the markers 110 in the temporary holding position are identified. Therefore, if the coordinates of the first reference (the first line segment 171 and the first point 172) in the first holding position are converted to coordinates of the embroidery coordinate system 100 in the temporary holding position, the coordinates of the first reference can be associated with the markers 110 in the temporary holding position. That is, the layout (including the position and the angle) of the markers 110 with respect to the first reference in the temporary holding position is identified.

Next, it is determined whether the value of the variable M is 2, namely, whether the detection processing has already been performed twice (step S81). When the value of the variable M is not 2 (NO at step S81), the variable M is incremented by 1 (step S82). Subsequently, second-time detection processing of the markers 110 in the temporary holding position is performed (step S83 to step S91). In order to change from the temporary holding position to the second holding position, this detection processing prompts the user to re-attach the markers 110 to appropriate positions, and detects the re-attached markers 110. The content of the processing is almost the same as the content of the detection processing (step S40 to step S48 of FIG. 9) of the markers 110 in the first holding position. Therefore, here, an explanation will be given only for the content of the processing that is different from that performed at step S40 to step S48.

First, at step S83, the marker layout positions are identified in the following manner. At step S79, the coordinates representing the markers 110 and the first reference (the first line segment 171 and the first point 172) have been identified in the embroidery coordinate system 100 in the temporary holding position. Therefore, based on the already determined layout relationship between the first pattern and the second pattern, the layout of the estimated range in which the second pattern is to be sewn can be identified in the temporary holding position. Positions which are located within the sewable area 86C of the temporary holding position and which are also located within the estimated range in which the second pattern is to be sewn are identified as the marker layout positions. In the example shown in FIG. 14, two areas 165A and 165B which are located within the sewable area 86C of the temporary holding position and which are also located within the estimated range (the smallest rectangle 230B) in which the second pattern (the pattern 152) is to be sewn may be identified as the marker layout positions. If the markers 110 are arranged in the areas 165A and 165B, it is possible to sew the pattern 152 by changing the holding position from the temporary holding position that corresponds to the sewable area 86C to the second holding position that corresponds to the sewable area 86B. In a similar manner to the areas 110A and 110B, it is preferable to arrange the areas 165A and 165B such that they are separated from each other by a certain distance.

Then, in a similar manner to the processing at step S41 to step S48 (refer to FIG. 9), processing is performed that prompts the user to attach the markers 110 to positions corresponding to the areas 165A and 165B, and sequentially detects the markers 110 attached to the positions, based on images captured by the image sensor 50 (step S84 to step S91). When the second marker 110 is detected (YES at step S90), the layout of the re-attached markers 110 with respect to the first reference in the temporary holding position is identified. The temporary marker layout that has already been stored in the RAM 63 is updated to the identified layout (step S95). For example, in the temporary holding position corresponding to the sewable area 86C shown in FIG. 14, the coordinates representing the first reference and the coordinates of the markers 110 attached to the positions corresponding to the areas 110A and 110B before the reattachment have already been identified. Therefore, based on these pieces of information and on the coordinates of the markers 110 re-attached to the positions corresponding to the areas 165A and 165B, it is possible to identify the layout (including the position and the angle) of the re-attached markers 110 with respect to the first reference in the temporary holding position.

After the temporary marker layout has been updated (step S95), the processing returns to step S80. Since the second-time detection processing ends and the variable M has been set to 2 (YES at step S80), a message indicating that the layout of the markers 110 with respect to the first reference is updated and an OK key (not shown in the drawings) are displayed on the LCD 7 (step S96). When the OK key is selected, a message that prompts the user to change the holding position of the sewing target object 39 and an OK key (not shown in the drawings) are displayed on the LCD 7 (step S97).

After the message has been displayed, the user changes the holding position of the sewing target object 39 with respect to the embroidery frame 84 (refer to FIG. 2) from, for example, the temporary holding position that corresponds to the sewable area 86C shown in FIG. 14 to the second holding position. The second holding position is, for example, the holding position corresponding to the sewable area 86B in which the two markers 110 arranged in the positions corresponding to the areas 165A and 165B and the smallest rectangle 230B corresponding to the pattern 152 can be arranged. The holding position is changed in a state in which the markers 110 are attached to the positions corresponding to the areas 165A and 165B on the sewing target object 39. Thus, even when the holding position of the sewing target object 39 by the embroidery frame 84 is changed, the layout of the markers 110 with respect to the sewing target object 39 is not changed. When the OK key is selected after the user has changed the holding position, the reattachment processing shown in FIG. 16 ends and the processing returns to the pattern connection processing shown in FIG. 9. The processing returns to step S53.

The processing returns to step S53 after the holding position has been changed from the first holding position to the second holding position in accordance with the message displayed at step S52, or after the holding position has been changed to the second holding position via the temporary holding position in the reattachment processing. When the pattern layout key is selected at step S53 on the screen displayed on the LCD 7 (NO at step S53, yes at step S55), the second pattern layout processing is performed (step S56, refer to FIG. 17). The second pattern layout processing is processing that identifies the layout of the markers 110 with respect to the first reference in the second holding position and determines the layout of the second pattern.

Figure 17:
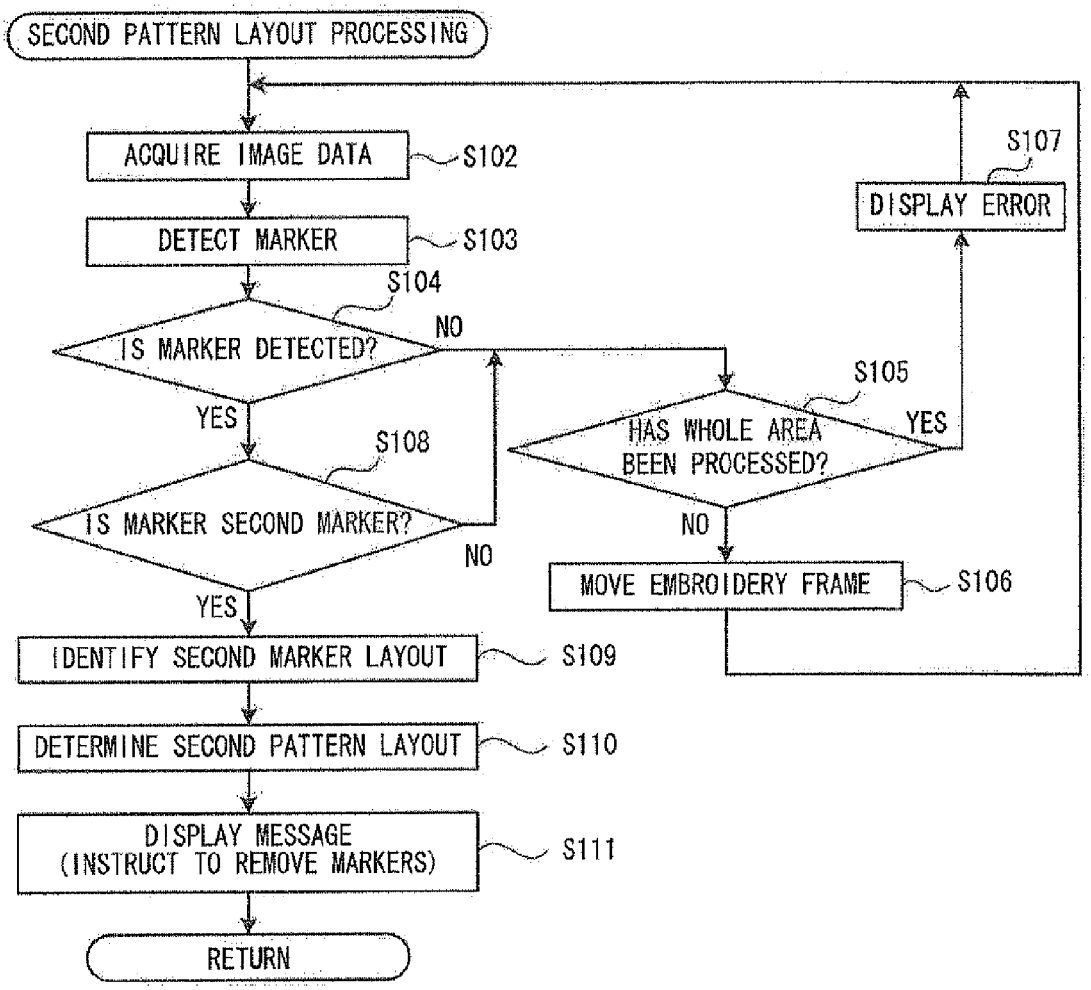
FIG. 17 is a flowchart of second pattern layout processing that is performed in the pattern connection processing.

As shown in FIG. 17, in the second pattern layout processing, first, detection processing is performed to detect the marker 110 attached to the marker layout position specified at step S41 of the pattern connection processing (FIG. 9) or step S84 of the reattachment processing (FIG. 16) (step S102 to step S107). This detection processing is the same as the first-time (M=1) detection processing (step S72 to step S77) in the reattachment processing, except that the holding position is different, and thus an explanation thereof is omitted here. When the second marker 110 is detected (YES at step S108), the layout of the markers 110 with respect to the first reference in the second holding position is identified based on the coordinates of the embroidery coordinate system 100 of the detected markers 110 in the second holding position and on the first marker layout or the temporary marker layout stored in the RAM 63. The identified layout of the markers 110 is stored in the RAM 63 as a second marker layout (step S109).

For example, as shown in FIG. 12 or FIG. 13, when the holding position is changed from the first holding position that corresponds to the sewable area 86A to the second holding position that corresponds to the sewable area 86B without changing to the temporary holding position, the first marker layout is stored in the RAM 63. Therefore, in this case, an associated relationship between the first reference and the markers 110 is identified by the coordinates of the embroidery coordinate system 100 in the first holding position. Further, at a point in time at which the holding position is changed to the second holding position, the embroidery coordinate system 100 in the second holding position is set and the coordinates of the markers 110 in the second holding position are identified. Therefore, if the coordinates of the first reference (the first line segment 171 and the first point 172) in the first holding position are converted to coordinates in the second holding position, the coordinates of the first reference can be associated with the markers 110 in the second holding position. That is, the layout of the markers 110 with respect to the first reference in the second holding position can be identified as the second marker layout.

On the other hand, for example, let us consider a case in which the holding position is changed from the first holding position that corresponds to the sewable area 86A to the second holding position that corresponds to the sewable area 86B via the temporary holding position that corresponds to the sewable area 86C, as shown in FIG. 14. In this case, the temporary marker layout, namely, the associated relationship between the first reference in the temporary holding position and the markers 110 re-attached to the positions that correspond to the areas 165A and 165B, is stored in the RAM 63. Similarly, in this case, the coordinates of the re-attached markers 110 in the second holding position are identified. Therefore, if the coordinates of the first reference (the first line segment 171 and the first point 172) in the temporary holding position are converted to coordinates in the second holding position, the coordinates of the first reference can be associated with the markers 110 in the second holding position. That is, the layout of the markers 110 (which are located in the positions corresponding to the areas 165A and 165B) with respect to the first reference in the second holding position can be identified as the second marker layout.

Next, based on the identified second marker layout and on the layout relationship of the second pattern with respect to the first pattern, the layout of the second pattern (the N-th pattern) with respect to the sewing target object 39 in the second holding position is determined (step S110). Further, at step S110, the sewing data of the N-th pattern is corrected based on the determined layout. Further, the determined layout (not shown in the drawings) of the N-th pattern is displayed on the LCD 7. After that, a message "Please remove the markers" (not shown in the drawings) is displayed on the LCD 7 (step S111). This completes the second pattern layout processing shown in FIG. 17, and the processing returns to the pattern connection processing shown in FIG. 9. When the pattern connection processing is also completed, the processing returns to the main processing shown in FIG. 5.

As shown in FIG. 5, in the main processing, when a sewing start key is selected (YES at step S7), sewing of the second pattern, which is the N-th pattern, is performed in the same manner as in the case of the first pattern (step S8). When the next pattern is further connected and sewn (YES at step S9), the same processing as that described above is repeated. When there is no next pattern to be connected and sewn (NO at step S9), the main processing ends.

As explained above, according to the sewing machine 1 of the present embodiment, the first pattern is sewn in a state in which the holding position of the sewing target object 39 by the embroidery frame 84 is the first position. Then, the layout of the second pattern with respect to the first pattern is determined based on the first reference and the second reference set in accordance with the commands input by the user. Before the holding position is changed to the second holding position in which the second pattern is sewn, the areas which are located within the sewable area 86 in the first holding position and which are also located within the estimated range in which the second pattern is to be sewn are identified as the marker layout positions. The image showing the marker layout positions is displayed on the screen displayed on the LCD 7. In a state in which the holding position is in the first holding position, the markers 110 are attached by the user to the positions corresponding to the marker layout positions on the sewing target object 39, and the image data of the image captured by the image sensor 50 is acquired. Based on the acquired image data, the layout of the markers 110 (the first marker layout) with respect to the first reference in the first holding position is identified. Further, after the holding position has been changed to the second holding position, the image data of the image captured by the image sensor 50 is acquired. Based on the acquired image data, the layout of the markers 110 (the second marker layout) with respect to the first reference in the second holding position is identified. The layout of the second pattern with respect to the sewing target object 39 in the second holding position is determined based on the layout of the second pattern with respect to the first pattern, the first marker layout and the second marker layout.

In this manner, in the sewing machine 1 of the present embodiment, the marker layout positions are identified and notified based on the settings (the first reference and the second reference) relating to the layout of the second pattern with respect to the first pattern. Therefore, the user can arrange the markers 110 in the notified marker layout positions. The marker layout positions are positions which are located within the sewable area 86 of the sewing target object 39 in the first holding position and which are also located within the estimated range in which the second pattern is to be sewn. Therefore, if the markers 110 are arranged in such positions, when the holding position of the sewing target object 39 is changed from the first holding position to the second holding position in order to sew the second pattern, there is a high possibility that both the markers 110 and the estimated range in which the second pattern is to be sewn fall within the sewable area 86 in the second holding position. That is, the user can easily arrange the markers 110 in appropriate positions. If the markers 110 and the estimated range in which the second pattern is to be sewn fall within the sewable area 86, thereafter, the positioning between the first pattern and the second pattern can be accurately performed by determining the layout of the second pattern with respect to the sewing target object 39 in the second holding position, based on the settings related to the layout of the second pattern with respect to the first pattern and based on the image data of the images including the markers 110 before and after the change of the holding position.

Further, in the present embodiment, the user is allowed to specify the first reference and the second reference by performing panel operations on the touch panel 8. Thus, the user can input and set a desired layout of the second pattern with respect to the first pattern. Further, since the image showing the marker layout positions is displayed on the LCD 7, the user can visually and easily identify the marker layout positions on the sewing target object 39. Thus, when the user actually arranges the markers 110 on the sewing target object 39, it is possible to reduce the possibility of arranging the markers 110 in erroneous positions. Further, in the sewing machine 1, under control of the CPU 61, the embroidery frame movement mechanism 11 can move the embroidery frame 84 such that the marker layout positions fall within the image capturing range 180 of the image sensor 50. Therefore, even when the sewable area 86 is wider than the image capturing range 180 of the image sensor 50, it is possible to reliably capture the image including the marker layout positions and to display the image on the LCD 7. Thus, the user can reliably arrange the markers 110 in the marker layout positions.

The sewing machine of the present disclosure is not limited to the above-described embodiment. As will be explained below, various modifications may be added.

For example, in the above-described embodiment, the first reference and the second reference specified by the user via panel operations are acquired as the settings related to the layout of the second pattern with respect to the first pattern. However, the settings related to the layout of the second pattern with respect to the first pattern need not necessarily be information input by the user via the touch panel 8. For example, there are cases in which an embroidery pattern that is larger than the sewable area is divided into a plurality of patterns that are smaller than the sewable area, and sewing data corresponding to the plurality of divided patterns is stored in the ROM 62 or the EEPROM 64 of the sewing machine 1. In this case, the layout relationship between the plurality of patterns is determined in advance. Therefore, settings related to the layout relationship between the plurality of patterns may be set in advance and stored in the ROM 62 or the EEPROM 64 such that the settings are included in the sewing data of the plurality of divided patterns. Note that, when the sewing machine 1 is provided with a connector that can be connected to an external storage device (for example, a memory card), sewing data stored in the external device may be read into the sewing machine 1 and used.

Figure 19:
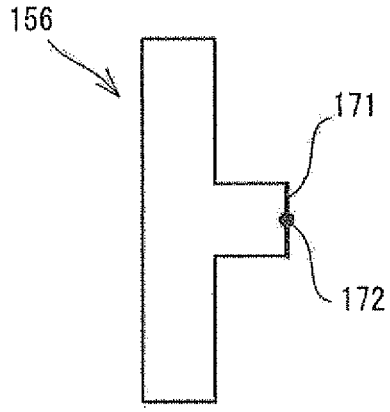
FIG. 19 is an explanatory diagram of a pattern 156 that is included in the pattern 155.
Figure 20:
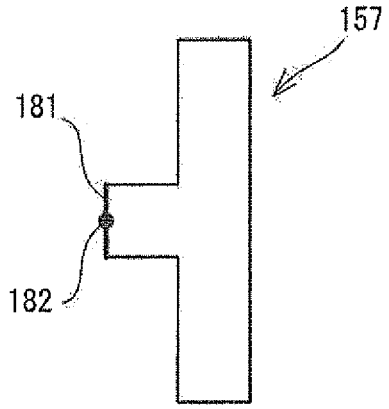
FIG. 20 is an explanatory diagram of a pattern 157 that is included in the pattern 155.

For example, a pattern 155 (FIG. 18) that shows the alphabetic character H is larger than the maximum sewable area 86 (refer to FIG. 2) in the embroidery frame 84. Therefore, the pattern 155 is divided into a pattern 156 (FIG. 19) that corresponds to the left half of the character H and a pattern 157 (FIG. 20) that corresponds to the right half of the character H.

Sewing data corresponding to the patterns 156 and 157 is stored in advance in the ROM 62 or the EEPROM 64. In order to form the pattern 155 showing the character H such that the pattern 155 has a good appearance, it is necessary to accurately perform positioning of the boundary between the pattern 156 and the pattern 157.

Therefore, the sewing data of the pattern 156 includes the coordinate data in the initial layout of the first line segment 171 and the first point 172, which are the first reference set in advance. The sewing data of the pattern 157 includes the coordinate data in the initial layout of the second line segment 181 and the second point 182, which are the second reference set in advance. Then, based on the coordinate data, it is defined that the first line segment 171 and the second line segment 181 are the same line segment, and the first point 172 and the second point 182 are the same point. More specifically, the layout relationship between the pattern 156 and the pattern 157 is set such that the first line segment 171 and the second line segment 181 overlap with each other and the first point 172 and the second point 182 overlap with each other, and the set layout relationship is stored in the ROM 62 or the EEPROM 64.

Figure 18:
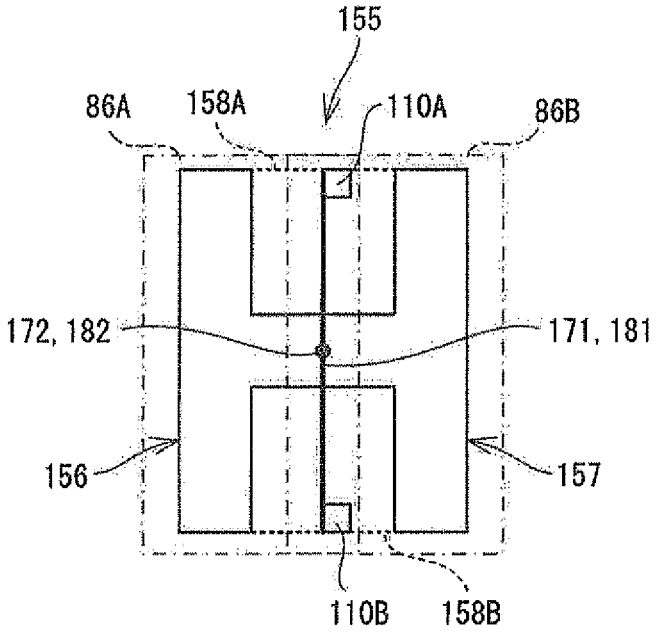
FIG. 18 is an explanatory diagram of a pattern 155.

In this type of case, in the pattern connection processing of the sewing machine 1, when the patterns 156 and 157 are connected and sewn, the processing at step S32 to step S33 of the pattern connection processing (FIG. 9), in which the user specifies the first reference and the second reference, is not required. The marker layout positions are identified based on the coordinate data of the first reference and the second reference included in the sewing data and stored in advance. For example, as shown in FIG. 18, when the pattern 156 is sewn in the first holding position that corresponds to the sewable area 86A, the marker layout positions are identified within the sewable area 86A and also within the estimated range in which the pattern 157 is to be sewn. Specifically, for example, the two rectangle areas 110A and 110B may be identified as the marker layout positions. The rectangle areas 110A and 110B are in contact with a line including the first line segment 171 and the second line segment 181, which are the same line segment, and are in contact, from the inside, with corners of a smallest rectangle 158B in which the pattern 157 can be arranged.

Alternatively, sewing ranges of the respective patterns may be smallest rectangles having a same size, and the sewing data of each of the patterns may include, in addition to the coordinate data indicating positions of needle drop points, information that indicates a position of the corresponding smallest rectangle as a position in a matrix including rows in the X-axis direction and columns in the Y-axis direction. In the example shown in FIG. 18, a smallest rectangle 158A corresponding to the pattern 156 is represented as an element in the first row and the first column, and the smallest rectangle 158B corresponding to the pattern 157 is represented as an element in the first row and the second column. In this case, the two smallest rectangles 158A and 158B have a same size. Therefore, if the smallest rectangles 158A and 158B are arranged based on information indicating the positions of the smallest rectangles 158A and 158B included in the sewing data, it is possible to accurately arrange the patterns 156 and 157 in positions adjacent to each other, and to identify appropriate marker layout positions.

As described above, the sewing machine 1 can identify and notify appropriate marker layout positions, in accordance with the settings related to the layout relationship between the pattern 156 and the pattern 157 included in the sewing data. Further, in accordance with the settings, it is possible to automatically perform appropriate positioning and to sew the pattern 155. Each time the patterns 156 and 157 are sewn sequentially, the user need not set the first reference and the second reference to connect the patterns 156 and 157.

Note that it is sufficient that the marker layout positions are positions which are located within the sewable area in the first holding position and which are also located within the estimated range in which the second pattern is to be sewn. Therefore, the marker layout positions need not necessarily be areas as exemplified in the above-described embodiment, and they may be points, for example. Further, when areas are identified as the marker layout positions, it is sufficient if at least a part of the areas is within the estimated range in which the second pattern is to be sewn. Further, the areas in this case need not necessarily be in contact, from the inside, with the corners of the smallest rectangle corresponding to the second pattern as exemplified in the embodiment, and the areas need not necessarily be in contact with the second line segment 181. Further, the method for notifying the marker layout positions may be changed as appropriate. For example, each of the marker layout positions may be displayed by a pattern, such as a cross or a star sign, or may be displayed by a contour that surrounds an area, such as a circle, an ellipse or a polygon. Further, the sewing machine 1 may be provided with a laser pointer, and the marker layout positions may be notified by directing a laser beam onto each of the marker layout positions. The sewing machine 1 may be provided with a projector and the marker layout positions may be projected onto the sewing target object.

It is sufficient that both the layouts of the first pattern and the second pattern include at least one of the position and the angle of the first pattern. Further, the graphics representing the ranges (estimated sewing ranges) in which the first pattern and the second pattern are to be sewn need not necessarily be the smallest rectangles corresponding to the first pattern and the second pattern. For example, each of the graphics may be one of a circle, an ellipse and a polygon in which each of the first pattern and the second pattern can be arranged. The first line segment 171 and the second line segment 181 may be a part of the contour of each of the graphics. It is sufficient that the first point 172 and the second point 182 are points that are included in the graphics, and they may be given points on the first line segment 171 and the second line segment 181 or may be points that are not on the first line segment 171 and the second line segment 181.

In the present embodiment, the sewing machine 1 having the plurality of needle bars 31 is shown as an example. However, an industrial-use sewing machine or a home-use sewing machine having a single needle bar may be used. The type and layout of the image sensor 50 may be changed as appropriate. For example, the image sensor 50 may be an imaging device other than the CMOS image sensor, such as a CCD camera.

The number of the markers 110 can be changed as appropriate. More specifically, the number of the markers 110 may be one or may be three or more. When the layout of the first pattern is identified based on a plurality of the markers 110, particularly, the angle can be accurately identified, as compared to a case in which the layout (the position and the angle) of the first pattern and the second pattern is identified based on the single marker 110. The layout of the markers 110 detected based on the image data may be at least one of the position and the angle of the markers 110. The configuration of the markers 110 may be changed as appropriate. The configuration of the markers 110 includes, for example, a size, a material, a design and a color of the markers 110. The method for arranging the markers 110 on the sewing target object 39 is not limited to attachment by adhesion, and another method, such as fastening by pins, may be used. The reference (the first center point 111 of the marker 110 in the above-described embodiment) to identify the layout of the markers 110, and its calculation method may be changed as appropriate, taking the configuration etc. of the markers 110 into consideration.

What is claimed is:

1. A sewing machine comprising:

an imaging device configured to capture an image of a sewing target object held by an embroidery frame;

a notification device configured to notify information;

a processor; and a memory storing computer-readable instructions therein, wherein the computer-readable instructions instruct the sewing machine to execute steps comprising:

acquiring settings related to a layout of a second pattern with respect to a first pattern, the first pattern being a pattern that is sewn in a first holding position of the sewing target object by the embroidery frame, and the second pattern being a pattern that is sewn subsequently to the first pattern in a second holding position of the sewing target object by the embroidery frame, the second holding position being different from the first holding position;

identifying, based on the acquired settings, a position which is located within a sewable area of the sewing target object in the first holding position and which is also located within an estimated range in which the second pattern is to be sewn, as a marker layout position;

causing the notification device to notify the identified marker layout position;

acquiring first image data indicating a first image including a marker arranged on the sewing target object, the first image being captured by the imaging device in the first holding position after the marker layout position has been notified by the notification device;

acquiring second image data indicating a second image including the marker, the second image being captured by the imaging device in the second holding position after the first image data has been acquired; and determining a layout of the second pattern with respect to the sewing target object in the second holding position, based on the acquired settings, the first image data and the second image data.

2. The sewing machine according to claim 1, further comprising:

an input device configured to receive input information;

wherein the computer-readable instructions further instruct the sewing machine to execute steps comprising:

acquiring, as the settings, input information relating to a layout of the second pattern with respect to the first pattern, the input information being received by the input device.

3. The sewing machine according to claim 1, wherein the notification device is a display; and wherein the computer-readable instructions further instruct the sewing machine to execute steps comprising:

causing the display to display the image of the sewing target object including the marker layout position captured by the imaging device, in a manner in which the marker layout position is identified.

4. The sewing machine according to claim 3, further comprising:

an embroidery frame movement device configured to move the embroidery frame;

wherein the computer-readable instructions further instruct the sewing machine to execute steps comprising:

causing the embroidery frame movement device to move the embroidery frame such that the identified marker layout position is within an image capturing range of the imaging device.

5. The sewing machine according to claim 1, wherein the settings related to a layout relationship of the second pattern with respect to the first pattern are included in sewing data of the first pattern and the second pattern.

6. A non-transitory computer-readable medium storing computer-readable instructions that, when executed, instruct a sewing machine to execute steps comprising:

acquiring settings related to a layout of a second pattern with respect to a first pattern, the first pattern being a pattern that is sewn in a first holding position of a sewing target object held by an embroidery frame, and the second pattern being a pattern that is sewn subsequently to the first pattern in a second holding position of the sewing target object held by the embroidery frame, the second holding position being different from the first holding position;

identifying, based on the acquired settings, a position which is located within a sewable area of the sewing target object in the first holding position and which is also located within an estimated range in which the second pattern is to be sewn, as a marker layout position;

causing a notification device to notify the identified marker layout position;

acquiring first image data indicating a first image including a marker arranged on the sewing target object, the first image being captured by an imaging device in the first holding position after the marker layout position has been notified by the notification device;

acquiring second image data indicating a second image including the marker, the second image being captured by the imaging device in the second holding position after the first image data has been acquired; and determining a layout of the second pattern with respect to the sewing target object in the second holding position, based on the acquired settings, the first image data and the second image data.

7. The computer-readable medium according to claim 6, wherein the acquiring of the settings related to the layout of the second pattern with respect to the first pattern comprises acquiring, as the settings, input information relating to the layout of the second pattern with respect to the first pattern, the input information received by an input device.

8. The computer-readable medium according to claim 6, wherein the notifying of the marker layout position comprises displaying, on a display that is the notification device, an image of the sewing target object including the marker layout position captured by the imaging device, in a manner in which the marker layout position is identified.

9. The computer-readable medium according to claim 8, wherein the computer-readable instructions further instruct the sewing machine to execute steps comprising:

moving the embroidery frame such that the identified marker layout position is within an image capturing range of the imaging device.

10. The computer-readable medium according to claim 6, wherein the settings related to a layout relationship of the second pattern with respect to the first pattern are included in sewing data of the first pattern and the second pattern.

11. A sewing machine comprising:

a processor; and a memory storing computer-readable instructions therein, wherein the computer-readable instructions instruct the sewing machine to execute steps comprising:

acquiring settings related to a layout of a second pattern with respect to a first pattern, the first pattern being a pattern that is sewn in a first holding position of a sewing target object held by a embroidery frame, and the second pattern being a pattern that is sewn subsequently to the first pattern in a second holding position of the sewing target object held by the embroidery frame, the second holding position being different from the first holding position;

identifying, based on the acquired settings, a position which is located within a sewable area of the sewing target object in the first holding position and which is also located within an estimated range in which the second pattern is to be sewn, as a marker layout position;

sending a notification instruction to a notification device, the notification instruction causing the notification device to notify the identified marker layout position;

acquiring, after the notification instruction has been sent to the notification device, first image data indicating a first image including a marker arranged on the sewing target object by sending a first imaging instruction to an imaging device in the first holding position;

acquiring, after the first image data has been acquired, second image data indicating a second image including the marker by sending a second imaging instruction to the imaging device in the second holding position; and determining a layout of the second pattern with respect to the sewing target object in the second holding position, based on the acquired settings, the first image data and the second image data.

* * * * *